US009487852B2

(12) United States Patent
Okada et al.

(10) Patent No.: US 9,487,852 B2
(45) Date of Patent: Nov. 8, 2016

(54) MANUFACTURING EQUIPMENT FOR GALVANIZED STEEL SHEET, AND MANUFACTURING METHOD OF GALVANIZED STEEL SHEET

(75) Inventors: Nobuyoshi Okada, Tokyo (JP); Masanori Hoshino, Tokyo (JP); Atsushi Sakatoku, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 394 days.

(21) Appl. No.: 13/818,128

(22) PCT Filed: Aug. 9, 2011

(86) PCT No.: PCT/JP2011/068138

§ 371 (c)(1),
(2), (4) Date: Feb. 21, 2013

(87) PCT Pub. No.: WO2012/029511

PCT Pub. Date: Mar. 8, 2012

(65) Prior Publication Data

US 2013/0156963 A1 Jun. 20, 2013

(30) Foreign Application Priority Data

Sep. 2, 2010 (JP) ..... 2010-196796

(51) Int. Cl.
*C23C 2/40* (2006.01)
*C23C 2/00* (2006.01)
(Continued)

(52) U.S. Cl.
CPC ..... *C23C 2/003* (2013.01); *C22C 18/04* (2013.01); *C23C 2/04* (2013.01); *C23C 2/06* (2013.01); *C23C 2/12* (2013.01); *C23C 2/28* (2013.01)

(58) Field of Classification Search
CPC ..... C23C 2/06; C23C 2/40; C23C 2/003
See application file for complete search history.

(56) References Cited

U.S. PATENT DOCUMENTS 5,084,094 A * 1/1992 Francois et al. ..... 75/663
5,558,715 A * 9/1996 Abed ..... C23C 2/32 118/423

(Continued)

FOREIGN PATENT DOCUMENTS

JP 02-104649 4/1990
JP 02-179858 7/1990

(Continued)

OTHER PUBLICATIONS

Search Report dated Oct. 22, 2014 issued in related European Application No. 11821530.0.

(Continued)

*Primary Examiner* — David Turocy
(74) *Attorney, Agent, or Firm* — Birch, Stewart, Kolasch & Birch, LLP

(57) ABSTRACT

A manufacturing equipment for galvanized steel sheet includes coating tub to coat steel sheet dipped in coating bath wherein the bath including molten zinc and Al is stored at bath temperature T1, separating tub to separate by a flotation top-dross by precipitating the top-dross in the bath wherein the bath transferred from the coating tub is stored at bath temperature T2 lower than T1, adjusting tub to dissolve dross wherein the bath transferred from the separating tub is stored at bath temperature T3 higher than T2 and Fe of the bath is unsaturated, and circulator to circulate the bath in order of the coating tub, the separating tub, and the adjusting tub.

6 Claims, 10 Drawing Sheets

(51) Int. Cl.

| | |
|---|---|
| ***C22C 18/04*** | (2006.01) |
| ***C23C 2/06*** | (2006.01) |
| ***C23C 2/12*** | (2006.01) |
| ***C23C 2/28*** | (2006.01) |
| ***C23C 2/04*** | (2006.01) |

(56) References Cited

U.S. PATENT DOCUMENTS

| | | | | |
|---|---|---|---|---|
| 6,426,122 | B1 * | 7/2002 | Ishii et al. | 427/433 |
| 2010/0323095 | A1 * | 12/2010 | Barjon et al. | 427/8 |
| 2013/0156964 | A1 | 6/2013 | Okada et al. | |

FOREIGN PATENT DOCUMENTS

| | | | |
|---|---|---|---|
| JP | 02179858 | A * | 7/1990 |
| JP | 04-099258 | | 3/1992 |
| JP | 05-271893 | | 10/1993 |
| JP | 05271893 | A * | 10/1993 |
| JP | 05-287481 | | 11/1993 |
| JP | 05-295507 | | 11/1993 |
| JP | 08-188859 | | 7/1996 |
| JP | 08-337858 | | 12/1996 |
| JP | 10-140309 | | 5/1998 |
| JP | 11-286761 | | 10/1999 |
| JP | 2001-262306 | | 9/2001 |
| JP | 2001262306 | A * | 9/2001 |
| JP | 2003-193212 | | 7/2003 |
| JP | 2008-095207 | | 4/2008 |
| KR | 10-2004-0057746 | | 7/2004 |
| WO | 2009/098362 | | 8/2009 |
| WO | 2009/098363 | | 8/2009 |
| WO | WO 2009098362 | A1 * | 8/2009 |

OTHER PUBLICATIONS

"Zinc Bath Management on Continuous Hot-Dip Galvanizing Lines", Aug. 2009, Galvinfonote 2.4.1, pp. 1-6.

U.S. Office Action dated Jul. 1, 2013 issued in U.S. Appl. No. 13/819,593.

Office Action dated Jul. 29, 2014 issued in related Korean Application No. 10-2013-7005791 [with English Translation].

U.S. Office Action dated Jun. 13, 2014 issued in U.S. Appl. No. 13/819,593.

International Search Report dated Sep. 6, 2011, issued in corresponding PCT Application No. PCT/JP2011/068138.

International Search Report dated Sep. 6, 2011, issued in related PCT Application No. PCT/JP2011/068142.

Japanese Decision of Rejection dated Sep. 25, 2012, issued in related Japanese Application No. 2011-547632, and English translation.

* cited by examiner a) OPERATION BY 150 M/MIN OR LESS b) OPERATION BY HIGH-SPEED

MANUFACTURING EQUIPMENT FOR GALVANIZED STEEL SHEET, AND MANUFACTURING METHOD OF GALVANIZED STEEL SHEET

TECHNICAL FIELD

The present invention relates to manufacturing equipment for a galvanized steel sheet and a manufacturing method of the galvanized steel sheet. In particular, it relates to the equipment and the method for the galvanized steel sheet to make dross, which forms when the galvanized steel sheet is manufactured, harmless.

This application is a national stage application of International Application No. PCT/JP2011/068138, filed Aug. 9, 2011, which claims priority to Japanese Patent Application No. 2010-196796, filed Sep. 2, 2010, the content of which is incorporated herein by reference.

BACKGROUND ART

Hot dip zinc-aluminum coated steel sheets have been widely used in the fields of automobiles, consumer electronics, building materials and the like. A representative category of the coated steel sheets includes the following three types in order of aluminum (Al) content in coating bath.

(1) Galvannealed steel sheets (composition of coating bath: for example, 0.125 to 0.14 mass % Al—Zn)

(2) Galvanized steel sheets (composition of coating bath: for example, 0.15 to 0.25 mass % Al—Zn)

(3) Zinc-aluminum alloy coated steel sheets (composition of coating bath: for example, 2 to 25 mass % Al—Zn)

As described above, the hot dip zinc-aluminum coated steel sheets are steel sheets which are coated by using the coating bath including molten metal such as molten zinc and molten aluminum. In the coating bath, zinc (Zn) is the main ingredient, aluminum (Al) is added in order to improve coating adhesion and corrosion resistance, and substances such as magnesium (Mg), silicon (Si) and the like may be added in order to improve the corrosion resistance.

Hereinafter, the galvannealed steel sheet is referred to as "GA" and the coating bath for manufacturing the galvannealed steel sheet is referred to as "galvannealed bath (GA bath)". The galvanized steel sheet is referred to as "GI" and the coating bath for manufacturing the galvanized steel sheet is referred to as "galvanized bath (GI bath)".

When the above-mentioned hot dip zinc-aluminum coated steel sheets are manufactured, a large amount of inclusions called dross forms in the coating bath. The dross is made of intermetallic compounds of Iron (Fe) dissolved in the coating bath from the steel sheet and Al or Zn included in the coating bath (molten metal). Specific compositions of the intermetallic compounds are, for example, $Fe_2Al_5$ which represents top-dross and $FeZn_7$ which represents bottom-dross. The top-dross may form in all of the coating bath (for example, GA bath, GI bath) for manufacturing the hot dip zinc-aluminum coated steel sheets. On the other hand, the bottom-dross only forms in the galvannealed bath (GA bath).

Since the specific gravity of the top-dross is smaller than that of the molten metal which is the coating bath, the top-dross flows in the coating bath, and finally rises to top surface of the coating bath. When a large amount of the top-dross flows in the coating bath, the top-dross accumulates on the surface of the roll in the coating bath, which may cause surface defects on the steel sheets. Also the flowing top-dross accumulates in grooves of the roll in the coating bath, which may cause roll-slipping and roll-idling because of the decrease in the apparent friction coefficient between the roll and the steel sheet. In addition, when a relatively large size of the top-dross adheres to the steel sheet, the quality of appearance of a product deteriorates and the product becomes off-grade in some cases.

On the other hand, since the specific gravity of the bottom-dross is greater than that of the molten metal which is the coating bath, the bottom-dross flows in the coating bath, and finally deposits on the bottom of the coating tub. When a large amount of the bottom-dross flows in the coating bath, in the same way as the top-dross, the bottom-dross causes problems such as defects in the roll in the coating bath, roll-slipping, roll-idling, remarkable deterioration of the quality of the appearance which results from its adhesion to the steel sheet, and the like. Moreover, the bottom-dross does not rise to the top surface and is not rendered harmless like the top-dross. The bottom-dross flows in the coating bath for a long time, and the bottom-dross, which deposits on the bottom of the coating tub once, reflows in the coating bath again by transition of the coating bath flow. Therefore, it can be said that the bottom-dross is more harmful than the top-dross.

In particular, when the sheet threading speed of the steel sheet dipped into the coating bath is accelerated in order to improve productivity of the coated steel sheets, the bottom-dross which deposits on the bottom of the coating tub rises in the coating bath due to the coating bath flow which is derived from high-speed threading of the steel sheet. The above-mentioned dross adheres to the steel sheet and causes the dross defects on the steel sheets, which results in a factor of degradation of the coated steel sheet. Therefore, hitherto, the sheet threading speed of the steel sheet was suppressed and the productivity had to be sacrificed in order to ensure the quality of the coated steel sheets.

To solve the above-mentioned problems caused by the top-dross and the bottom-dross, many suggestions have been made in the past. As shown below, the suggestions are commonly methods of sedimentation separation and flotation separation of the dross by using the difference in specific gravity between the coating bath and the dross.

For example, in Patent Document 1, dross removal equipment is suggested, in which molten zinc including the dross is transferred from a coating tub to a storage tub and the dross is separated by sedimentation and flotation by using the difference in specific gravity between the dross and the coating bath. In the equipment, the capacity of the storage tub is 10 $m^3$ or more, the transfer volume of the molten zinc is 2 $m^3$/hour or more, and a baffle plate is installed in the storage tub to divert the coating bath flow. However, in Patent Document 1, the dross removal effect is overestimated because of utilization of an equation which is applicable to the particle sedimentation in case of a relatively slow coating bath flow. In addition, although the harmful size of dross is defined as 100 μm or more in Patent Document 1, the dross defects which are recently regarded as the problem include defects which are derived from dross with a size of approximately 50 μm. In fact, a countermeasure with a greater effect than that of Patent Document 1 is necessary. On the contrary, in a method described in Patent Document 1, in order to remove the dross with the size of approximately 50 μm, the capacity of the storage tub needs to be 42 $m^3$ or more, which is not practical because the equipment must be larger. Moreover, in order to minimize the equipment, since sedimentation velocity of the bottom-dross is slow, the countermeasure other than Patent Document 1 is necessary.

In Patent Document 2, a coating equipment is suggested, in which enclosing parts are installed in a coating tub and the rise of the bottom-dross is suppressed by sedimenting and depositing the bottom-dross underneath the enclosing parts. However, in a method described in Patent Document 2, the bath flow at an upper area in the coating bath increases with an increase in coating rate, so that the bath flow at a lower area in the coating bath also increases gradually. Thus, since the dross with small size does not sediment and flows back to the upper area with the coating bath flow, the dross removal efficiency is low. Moreover, in case of the coating tub with practical capacity (for example, 200 ton), the dross with small size flows back between the upper area and the lower area of the coating bath, grows with time passage, and finally sediments in the lower area. However, at the time, a large amount of the bottom-dross which grows up to size which is enable to sediment flows in the upper area and the lower area of the coating bath, so that the effect as the countermeasure against the dross defects is low. Moreover, although it is necessary to remove eventually the bottom-dross which deposited at the lower area, dross cleanup operation is substantially impossible if the enclosing parts exist. Since considerable time and effort are needed for dismantlement of the enclosing parts, it can be said that technology described in Patent Document 2 is not practical.

In the equipment suggested in Patent Document 3, a coating container is divided into a coating tub and a dross removal tub, and the molten metal in the coating tub is transferred to the dross removal tub by using a pump. Moreover, the dross is separated by the sedimentation in the dross removal tub and the purified bath flows back in the coating tub through opening portion provided for the coating tub. However, since a method described in Patent Document 3 is the method in which the dross is separated by simply using the difference in specific gravity between the dross and the bath, separation efficiency of the dross with small size is low and the dross flows back to the coating tub with the coating bath flow. Moreover, in case of the dross removal tub with practical capacity (for example, 200 ton), the dross with small size which is formed in the coating tub circulates between the coating tub and the dross removal tub with the coating bath flow, grows with time passage, and finally sediments at the dross removal tub. However, at the time, a large amount of the bottom-dross which grows up to size which is enable to sediment flows in the coating tub and the dross removal tub, so that it can be said that the effect of technology described in Patent Document 3 is low as the countermeasure against the dross defects.

In addition, in the coating equipment suggested in Patent Document 4, the coating bath in a coating pot is transferred to a crystallization pipe, and is cooled and heated repeatedly several times in the crystallization pipe. Thereby, the dross is grown and removed, and the purified bath is reheated in a reheating tub and returned to the coating pot. Moreover, in the coating method suggested in Patent Document 5, a sub pot is additionally installed in a coating pot. The molten metal which includes the bottom-dross is transferred from the coating pot to the sub pot, the bath in the sub pot is held at higher temperature than that of the coating pot, and Al concentration is increased 0.14 mass % or more. Thereby, the bottom-dross in the coating bath is transformed into the top-dross, and the top-dross is removed by the flotation separation.

RELATED ART DOCUMENTS

Patent Documents

[Patent Document 1] Japanese Unexamined Patent Application, First Publication No. H10-140309

[Patent Document 2] Japanese Unexamined Patent Application, First Publication No. 2003-193212

[Patent Document 3] Japanese Unexamined Patent Application, First Publication No. 2008-095207

[Patent Document 4] Japanese Unexamined Patent Application, First Publication No. H05-295507

[Patent Document 5] Japanese Unexamined Patent Application, First Publication No. H04-99258

SUMMARY OF INVENTION

Technical Problem

As mentioned above, the conventional dross removal methods described in Patent Documents 1 to 3 are generally the method in which bath temperature control of the coating bath is not conducted and the dross is separated by the sedimentation and the flotation by simply using the difference in specific gravity between the dross and the coating bath. However, in the removal methods, there was the problem such that the dross with small size flowed back to the coating tub with the coating bath flow, the dross could not be removed completely, and the dross removal efficiency was low. Moreover, the dross with small size in the coating bath circulates between the separation tub and the coating tub with the coating bath flow, grows with time passage, and finally sediments at the separation tub. However, at the time, a large amount of the dross which grows up to size which is enable to sediment flows in the coating bath. Thus the effect as the countermeasure against the dross defects of the coated steel sheets was low.

On the other hand, in the method described in Patent Document 4, the molten metal in the coating tub is transferred to the crystallization pipe, the coating bath is cooled and heated repeatedly several times, and thereby, the dross is grown and removed. However, in order to utilize the method described in Patent Document 4 effectively, as described in Example in Patent Document 4, large flow of bath circulation such that circulating volume of the coating bath is 0.5 $m^3$/min (approximately 200 ton/hour) is necessary. In order to conduct continuously the cooling and the heating for 2 hours for the large flow of the coating bath as described in the Example, the crystallization pipe with the capacity of 60 $m^3$ (approximately 400 ton) and a cooling system and heating system of high power are necessary. Moreover, in Patent Document 4, a method of removing the dross which is grown in the crystallization pipe is not disclosed. In case that the dross is removed by using a filter, exchange operation thereof is substantially impossible. And, in case that the dross is removed by the sedimentation separation, a sedimentation tub is additionally needed, so that operation is substantially difficult even if being theoretically possible. Therefore, it can be said that the method described in Patent Document 4 is not practical.

In addition, in the method described in Patent Document 5, the coating bath in the sub pot is held at higher temperature than that of the coating pot, Al concentration is increased, the bottom-dross in the coating bath is transformed into the top-dross, and thereby the top-dross is removed by the flotation separation. However, as described in Example in Patent Document 5, in the conditions such that bath temperature is heated to 500° C., 550° C. and Al concentration is increased to 0.15 mass % in the coating pot by using the coating bath from the coating pot (bath temperature of 460° C., Al concentration of 0.1 mass %), a part of the bottom-dross may be transformed into the top-dross and be removed by the flotation separation. However, by the method, since solubility limit of Fe of the coating bath increases drastically (saturated concentration of Fe in the coating pot of 0.03 mass %, saturated concentration of Fe in the sub pot of 0.09 mass % or more), most of the dross is dissolved in the coating bath. Namely, since the solubility limit of Fe of the coating bath increases with an increase in the bath temperature of the coating bath in the sub pot, most of the dross is dissolved in the coating bath, so that the dross cannot be separated by the flotation in the sub pot. Thus, when the coating bath in the sub pot is cooled and transferred to the coating pot, a large amount of the dross is formed, which is caused by the difference in Fe solubility. As mentioned above, the method described in Patent Document 5 is much doubtful about the dross removal effect in actuality. Moreover, in the method described in Patent Document 5, after the dross cleanup operation of the sub pot, the coating bath in the sub pot is cooled to the bath temperature of the coating pot, and the coating bath is reused. Therefore, since the dross cleanup operation of the sub pot must be batch processing, the dross removal efficiency is inferior to the case that the dross cleanup processing is consecutively conducted.

As mentioned above, the methods of removing the dross which flows in the coating bath are investigated for many years, most of the methods are the method which uses the difference in specific gravity between the dross and the coating bath (refer to Patent Documents 1 to 3). Among them, in case of the method of the sedimentation separation of the bottom-dross, since the difference in specific gravity between the bottom-dross and the molten zinc bath is small, sedimentation speed is slow. Thus it was difficult to almost-completely render the dross harmless (dross-free) by the practical capacity of the separating tub.

On the other hand, the method of the flotation separation of the top-dross is more advantageous than the method of the sedimentation separation of the bottom-dross. However, under the general operational condition of the GA, since the dross may form in the state of the bottom-dross only or a mixture of the bottom-dross and the top-dross, the method of transforming the bottom-dross into the top-dross is necessary. Some technologies are disclosed as the methods (for example, refer to Patent Document 5).

However, as described above, since the conventional dross removal methods which were suggested until now are difficult to control Al concentration of the coating bath and the technical idea thereof may be technical unreasonableness, the methods are not practicalized. In the conventional methods, the dross removal efficiency and effect were insufficient, and the dross removal effect itself was much doubtful.

The present invention is achieved in view of the above-mentioned problems. An object of the present invention is to provide a manufacturing equipment for a galvanized steel sheet and a manufacturing method of a galvanized steel sheet which are new and improved, in which the dross which forms inevitably in the coating bath during the manufacture of the galvanized steel sheet can be removed efficiently and effectively and can be almost-completely rendered harmless.

Solution to Problem

The inventors has investigated with singleness of purpose in view of the above-mentioned circumstance, and found the method which almost-completely renders dross harmless (dross-free) by removing the dross efficiently and effectively within the system. The method, in which coating bath is circulated between the divided and installed 3 tubs which are a coating tub, a separating tub, and an adjusting tub, utilizes concurrently (1) a process of separating the dross by using the difference in specific gravity by precipitating intentionally the top-dross in the coating bath at the separating tub where bath temperature thereof is lower than that of the coating tub and (2) a process of dissolving and removing the top-dross which is not able to be separated and removed in the separating tub by controlling Fe of the coating bath to be an unsaturated state in the adjusting tub where bath temperature thereof is higher than that of the separating tub.

In order to accomplish the aforementioned object, each aspect of the present invention employs the following.

(a) A manufacturing equipment for a galvanized steel sheet according to an aspect of the invention, the manufacturing equipment includes:

a coating tub to coat a steel sheet which is dipped in a coating bath, wherein the coating tub has a first temperature controller to keep the coating bath which is a molten metal including a molten zinc and a molten aluminum to a predetermined bath temperature T1;

a separating tub which has a second temperature controller to keep the coating bath transferred through a coating bath outlet of the coating tub to a bath temperature T2 which is lower than the bath temperature T1;

an adjusting tub which has a third temperature controller to keep the coating bath transferred from the separating tub to a bath temperature T3 which is higher than the bath temperature T2; and a circulator to circulate the coating bath in order of the coating tub, the separating tub, and the adjusting tub.

(b) The manufacturing equipment for the galvanized steel sheet according to (a), the manufacturing equipment may further include, an aluminum concentration analyzer to measure an aluminum concentration A1 of the coating bath in the coating tub, wherein a first zinc-included-metal which includes an aluminum with a concentration higher than the aluminum concentration A1 of the coating bath in the coating tub may be supplied to at least one of the separating tub and the adjusting tub depending on a measurement result of the aluminum concentration analyzer.

(c) In the manufacturing equipment for the galvanized steel sheet according to (b), the first zinc-included-metal may be supplied to the separating tub, and a second zinc-included-metal which is a zinc-included-metal which includes an aluminum with a concentration lower than an aluminum concentration A2 of the coating bath in the separating tub or a zinc-included-metal which does not include an aluminum may be supplied to the adjusting tub depending on the measurement result of the aluminum concentration analyzer.

(d) In the manufacturing equipment for the galvanized steel sheet according to (b), the first zinc-included-metal may be supplied to the separating tub, and a metal may not be supplied to the adjusting tub depending on the measurement result of the aluminum concentration analyzer.

(e) The manufacturing equipment for the galvanized steel sheet according to (b), the manufacturing equipment may further include, a premelting tub to melt the first zinc-included-metal or the second zinc-included-metal, wherein a molten metal of the first zinc-included-metal or the second zinc-included-metal which is melted in the premelting tub may be supplied to the coating bath in the adjusting tub.

(f) In the manufacturing equipment for the galvanized steel sheet according to (a), the bath temperature T2 of the separating tub may be controlled by the second temperature controller to be lower 5° C. or more as compared with the bath temperature T1 of the coating tub and to be higher than a melting point of the molten metal.

(g) In the manufacturing equipment for the galvanized steel sheet according to (a), the bath temperature T3 may be controlled by the third temperature controller so that the bath temperature T1, the bath temperature T2, and the bath temperature T3 satisfy a following formula (1) and a following formula (2) in celsius degree, when a difference of a bath temperature decrease of the coating bath when transferred from the adjusting tub to the coating tub is $\Delta T_{fall}$ in celsius degree.

$$T1+\Delta T_{fall}-10 \leq T3 \leq T1+\Delta T_{fall}\pm 10 \quad (1)$$

$$T2+5 \leq T3 \quad (2)$$

(h) In the manufacturing equipment for the galvanized steel sheet according to (a), the circulator may include a molten metal transfer apparatus which is installed in at least one of the coating tub, the separating tub, and the adjusting tub.

(i) In the manufacturing equipment for the galvanized steel sheet according to (a), the coating bath outlet of the coating tub may be located on a downstream side of a running direction of the steel sheet so that the coating bath flows out of an upper part of the coating tub by a flow of the coating bath which is derived from a running of the steel sheet.

(j) In the manufacturing equipment for the galvanized steel sheet according to (a), at least two of the coating tub, the separating tub, and the adjusting tub may be made by dividing one tub with a weir, and a bath temperature of each tub which is divided by the weir may be controlled independently.

(k) In the manufacturing equipment for the galvanized steel sheet according to (a), a storage of the coating bath in the coating tub may be five times or less of a circulating volume of the coating bath per one hour by the circulator.

(l) In the manufacturing equipment for the galvanized steel sheet according to (a), a storage of the coating bath in the separating tub may be two times or more of a circulating volume of the coating bath per one hour by the circulator.

(m) A manufacturing method of a galvanized steel sheet according to an aspect of the invention, the manufacturing method includes:

circulating a coating bath which is a molten metal including a molten zinc and a molten aluminum in order of a coating tub, a separating tub, and an adjusting tub;

coating a steel sheet which is dipped in the coating bath at the coating tub in which the coating bath transferred from the adjusting tub is stored at a predetermined bath temperature T1;

separating by a flotation a top-dross which is precipitated at the separating tub in which the coating bath transferred from the coating tub to the separating tub is stored at a bath temperature T2 which is lower than the bath temperature T1 of the coating tub; and dissolving a residual dross at the adjusting tub in which the coating bath transferred from the separating tub is stored at a bath temperature T3 which is higher than the bath temperature T2 of the separating tub.

According to the manufacturing equipment and the manufacturing method for the galvanized steel sheet described in the above (a) and (m), the coating bath is circulated in order of the coating tub, the separating tub, and the adjusting tub. Thereby, in the coating tub, the stagnation time of the circulation bath can be shortened, so that it is possible to avoid that the dross forms in the coating tub and grows up to the harmful size. In the separating tub, Fe is supersaturated by decreasing the bath temperature of the circulation bath, so that it is possible to precipitate Fe of the coating bath as the top-dross and to separate by the flotation. Moreover, in the adjusting tub, Fe of the coating bath is unsaturated by increasing the bath temperature of the circulation bath, so that it is possible to dissolve and remove the top-dross with small size which is not able to be separated and removed in the separating tub.

Advantageous Effects of Invention

According to the invention described in the above (a) and (m), the formation and growth of the dross are suppressed in the coating tub, the top-dross is separated and removed in the separating tub, and the residual dross is dissolved in the adjusting tub. Thereby, it is possible that the dross which forms inevitably in the coating bath is almost-completely rendered harmless.

According to the invention described in the above (b), Zn and Al which are consumed by the coating process at the coating tub are supplied by supplying the metal to the separating tub or the adjusting tub. Thereby, it is possible that the dross formation caused by melting the metal at the coating tub is prevented and the coating bath in the coating tub is controlled to the Al concentration (for example, 0.200 mass %) which is suitable for manufacturing the GI.

According to the invention described in the above (c), the Al concentration of the coating bath which is stored in the separating tub is controlled to be higher than the concentration of the coating tub and the adjusting tub. Thereby, it is possible that the large amount of the top-dross is precipitated and separated by the flotation.

According to the invention described in the above (d), the supply for the bath element and the adjustment of the Al concentration are conducted by supplying the metal only to the adjusting tub 3. Thereby, since it is not necessary to supply the metal to the separating tub 2, it is possible to simplify the equipment configuration.

According to the invention described in the above (e), it is not necessary to melt the metal in the adjusting tub. Thereby, it is possible to suppress the drastic decrease in the temperature of the molten metal caused by supplying the metal and the formation of the dross therefor at the adjusting tub.

According to the invention described in the above (f), the solubility limit of Fe of the coating bath which is stored in the separating tub decreases. Thereby, it is possible that the dross which is equivalent to the amount of supersaturated Fe is intentionally precipitated.

According to the invention described in the above (g), the bath temperature of the coating bath which is stored in the adjusting tub is held higher than that of the separating tub and the bath temperature deviation of the coating bath in the coating tub decreases. Thereby, it is possible to dissolve the residual dross at the adjusting tub and to suppress the formation of the dross with harmful size at the coating tub.

According to the invention described in the above (h), the circulation of the coating bath between the coating tub, the separating tub, and the adjusting tub is conducted by one molten metal transfer apparatus. Thereby, it is possible to simplify the equipment configuration.

According to the invention described in the above (i), the local stagnation area of the coating bath 10A in the coating tub 1 is hardly formed. Thereby, it is possible to avoid that the dross grows up to the harmful size at the stagnation area in the coating tub 1.

According to the invention described in the above (j), two or three tubs of the coating tub, the separating tub, and the adjusting tub are made as one. Thereby, it is possible to simplify the equipment configuration.

According to the invention described in the above (k), the stagnation time of the coating bath in the coating tub is shortened. Thereby, it is possible to make the dross flow out of the coating tub to the separating tub before the dross grows up to the harmful size.

According to the invention described in the above (l), the stagnation time of the coating bath in the separating tub is prolonged. Thereby, it is possible to sufficiently remove the top-dross at the separating tub.

DESCRIPTION OF EMBODIMENTS

Figure 1:
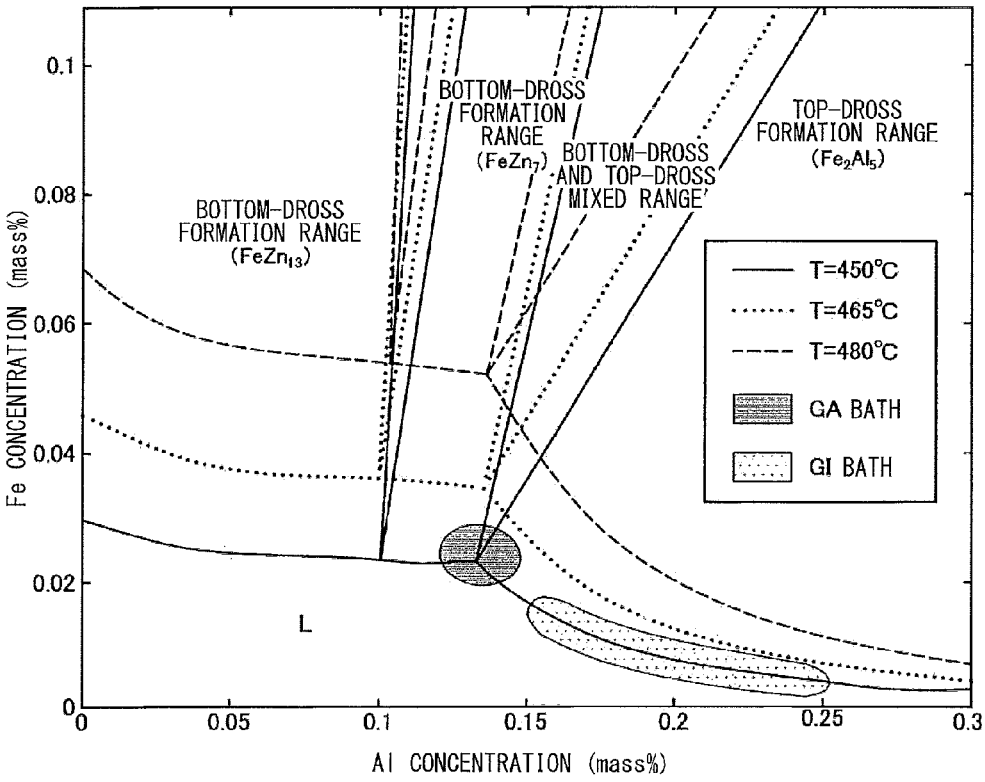
FIG. 1 is a ternary phase diagram which indicates a dross formation range in various coating baths.

Hereinafter, a preferable embodiment of the present invention will be described in detail with reference to the drawings. Moreover, in regard to the component which has the substantial same function, duplicate explanations are omitted by adding the same reference sign in the specification and the drawings.

1. Investigation of Dross Formation and Dross Removal Methods

First of all, in advance of explanations of manufacturing equipment for a galvanized steel sheet and a manufacturing method of the galvanized steel sheet according to an embodiment of the present invention, the result of the investigation of factors of dross formation (top-dross, bottom-dross) in coating bath and the dross removal methods will be described.

[1.1. Dross Formation Range]

As mentioned above, the hot dip zinc-aluminum coated steel sheets are the steel sheets which are coated by using the molten metal in which zinc is the main ingredient and aluminum is added. For example, (1) the galvannealed steel sheets, (2) the galvanized steel sheets, and (3) the zinc-aluminum alloy coated steel sheets.

The galvannealed steel sheets (GA) are the steel sheets in which the Zn—Fe intermetallic compound layer is formed by heating for short time at 490 to 600° C. just after galvanizing and by alloying molten Zn and steel. For example, the GA is frequently utilized as automobile steel sheets and the like. Coating layer of the GA includes the alloy of Fe which is dissolved in the coating bath from the steel sheet and Zn. Composition of the coating bath (GA bath) for manufacturing the GA includes, for example, Al of 0.125 to 0.14 mass % and Zn as the balance. The GA bath further includes Fe which is dissolved in the coating bath from the steel sheet. In the GA bath, the relatively low-concentration A1 is added to Zn bath in order to improve coating adhesion. When the Al concentration in the GA bath is excessively high, the alloying of Fe and Al in the coating layer barely occurs by so-called aluminum barriers, so that the Al concentration in the GA bath is controlled to a predetermined low concentration (0.125 to 0.14 mass %).

The galvanized steel sheets (GI) are frequently utilized as general building materials and the like. Composition of the coating bath (GI bath) for manufacturing the GI includes, for example, Al of 0.15 to 0.25 mass % and Zn as the balance. By controlling the Al concentration of the GI bath to 0.15 to 0.25 mass %, the adhesion of the coating layer to the steel sheet is particularly improved, so that exfoliation of the coating layer can be suppressed even if the steel sheet is deformed.

The zinc-aluminum alloy coated steel sheets are frequently utilized as general building materials in which high durability is required and the like, for example. Composition of the coating bath for manufacturing the above steel sheets is Al of 5 mass % and Zn as the balance, Al of 11 mass % and Zn as the balance, and the like. Since the sufficient amount of Al is contained in the Zn bath, higher corrosion resistance is obtained as compared with the GI.

In the coating bath for manufacturing the hot dip zinc-aluminum coated steel sheets, the top-dross and the bottom-dross which are the intermetallic compounds of Fe dissolved in the coating bath and Al or Zn are formed in large amount. The dross formation in the coating bath depends on temperature of the coating bath (bath temperature), the Al concentration in the coating bath, and Fe concentration in the coating bath (solubility of Fe dissolved in the coating bath from the steel sheet).

FIG. 1 is a ternary phase diagram which indicates the dross formation range in the various coating baths. In the FIG. 1, horizontal axis is the Al concentration (mass %) in the coating bath and vertical axis is the Fe concentration (mass %) in the coating bath.

As shown in FIG. 1, when the Fe concentration in the coating bath exceeds the predetermined concentration which depends on the Al concentration, the dross is formed. For example, in regard to the GA bath where the bath temperature T is 450° C. and the Al concentration is 0.13 mass %, when the Fe concentration in the coating bath becomes approximately more than 0.025 mass %, the bottom-dross ($FeZn_7$) is formed. Moreover, in regard to the GA bath where the bath temperature T is 450° C. and the Al concentration is 0.14 mass %, the top-dross ($Fe_2Al_5$) is formed when the Fe concentration becomes approximately more than 0.025 mass %, and the bottom-dross ($FeZn_7$) is formed in addition to the top-dross when the Fe concentration further increases. As described above, the top-dross and the bottom-dross are formed and mixed under the conditions.

On the other hand, since the Al concentration of the GI bath (for example, 0.15 to 0.25 mass %) is higher than that of the GA bath, the dross which is formed in the GI bath is only the top-dross ($Fe_2Al_5$). For example, in regard to the GI bath where the bath temperature T is 450° C., when the Fe concentration in the coating bath becomes approximately more than 0.01 mass %, the top-dross is formed. Moreover, in regard to the coating bath for the zinc-aluminum alloy coated steel sheets even though it is not illustrated, only the top-dross is also formed since the Al concentration is sufficiently high (for example, 2 to 25 mass %).

In addition, as shown in FIG. 1, even if the coating bath is the same, lower limit of Fe concentration where the dross is formed increases with an increase in the bath temperature T. For example, in regard to the GI bath where the Al concentration is 0.2 mass %, conditions where the top-dross is formed are as follows: (1) the Fe concentration is approximately 0.007 mass % or more in case that the bath temperature T is 450° C., (2) the Fe concentration is approximately 0.014 mass % or more in case that the bath temperature T is 465° C., and (3) the Fe concentration is approximately 0.02 mass % or more in case that the bath temperature T is 480° C. Thus, when the Fe concentration in the GI bath is constant (for example, 0.01 mass % Fe), the supersaturated state is shifted to the unsaturated state in regard to Fe by increasing the bath temperature T from 450° C. to 465° C., so that the top-dross is dissolved in the GI bath and disappears. On the contrary, the unsaturated state is shifted to the supersaturated state in regard to Fe by decreasing the bath temperature T from 465° C. to 450° C., so that the top-dross is formed in the GI bath.

[1.2. Factors of Dross Formation]

Next, the factors of the dross formation in the coating bath will be described. As the factors of the dross formation, the following factors (1) to (3) are considered, for example. Hereinafter, each factor will be described.

(1) Melting the Metal to the Coating Bath

In order to supply the molten metal which is consumed for coating the steel sheet in a coating tub to the coating bath, the metal is used. The metal in a solid state is dipped into the hot coating bath at preferable timing during operation, is melted in the coating bath, and becomes the molten metal in a liquid state. Although zinc-included-metal which includes at least Zn for hot dip zinc coating, the zinc-included-metal includes the metal such as Al and the like besides Zn according to the composition of the coating bath. Although the melting point of the metal differs according to the composition of the metal, the melting point is 420° C. for example and is lower than the temperature of the coating bath (for example, 460° C.).

When the metal which is dipped into the coating bath is melted, the temperature of the molten metal around the metal decreases lower than the bath temperature T of the coating bath. Namely, temperature deviation between the temperature (for example, 420° C.) around the metal which is dipped into the coating bath and the bath temperature T (for example, 460° C.) of the coating bath arises. Thus, when Fe in the coating bath is the saturated state, a large amount of the dross is formed with comparative ease at low-temperature area around the metal. The phase of the formed dross is related to the phase diagram (refer to FIG. 1).

In general, since the steel sheet is constantly dipped into the coating tub and active iron surface is exposed, the Fe concentration in the coating bath is the saturated state. Thus, when the temperature of the molten metal around the metal decreases drastically by supplying the metal in the coating bath where Fe is the saturated state, the dross is formed by reacting the supersaturated Fe with Zn or Al in the coating bath. Moreover, when the metal is preliminarily melted by using a premelting tub and the molten metal is supplied to the coating bath in the coating tub, the dross is hardly formed because Fe in the premelting tub is the unsaturated state.

(2) Fluctuation of the Bath Temperature T

As the factor of the dross formation following the melt of the metal, the fluctuation of the bath temperature T of the coating bath is considered. Since the solubility limit of Fe in the coating bath increases with the increase in the bath temperature T, Fe is further dissolved from the steel sheet which is dipped into the coating bath and Fe in the coating bath reaches the saturated concentration promptly. When the bath temperature T of the coating bath decreases, Fe becomes the supersaturated state all over the coating bath and the dross is promptly formed. Furthermore, even if the low bath temperature T of the coating bath which includes the dross increases again and the solubility limit of Fe increases, the dross is not decomposed (does not disappear), because the dissolution rate of Fe from the steel sheet is faster than that of the decomposition (disappearance) of the dross. In other words, even if the bath temperature of the coating bath which is low temperature (supersaturated state of Fe) increases at the coating tub in which the steel sheet is dipped, the dross hardly disappears.

On the other hand, if the molten metal which is low temperature and includes the dross is transferred to a tub in which the steel sheet in not dipped, is heated, and is held for long time, the dross can be decomposed (can disappear), because Fe in the coating bath becomes the unsaturated state. Thus, based on the viewpoint, in the manufacturing equipment for the galvanized steel sheet according to the embodiment of the present invention as described later, after forming the dross in the coating bath at a separating tub, the coating bath is transferred to an adjusting tub in which the steel sheet in not dipped, the bath temperature T increases, and the dross is dissolved (disappears).

(3) Other Factors

The fluctuation of the Al concentration in the coating bath and the temperature deviation in the coating tub are also considered as the factor of the dross formation. When the Al concentration in the coating bath increases, the solubility limit of Fe in the coating bath decreases, so that the top-dross ($Fe_2Al_5$) which is the intermetallic compound of Al and Fe is readily formed. And, when coating bath flow in the coating tub decreases and mixing power in the coating tub decreases, temperature of the coating bath at bottom of the coating tub decreases, so that the dross is formed. Thereafter, when the coating bath flow increases again, the dross which deposits on the bottom of the coating tub rises in the coating bath.

[1.3. Separation of Dross by Using the Difference in Specific Gravity]

The methods of the flotation separation of the top-dross and of the sedimentation separation of the bottom-dross by using the difference in specific gravity between the molten metal which is the coating bath and the dross are known. In general, the specific gravity of the bottom-dross is, for example, 7000 to 7200 kg/m$^3$ and the specific gravity of the top-dross is, for example, 3900 to 4200 kg/m$^3$. On the other hand, although the specific gravity of the molten zinc bath fluctuates to a certain extent by the temperature and Al concentration thereof, it is, for example, 6600 kg/m$^3$.

As described above, in case of the separation of the dross by using the difference in specific gravity, since the difference in specific gravity between the top-dross and the molten zinc bath is large and the top-dross readily rises to top surface, it is relatively easy to separate the top-dross by the flotation and to remove the top-dross outside the system. On the contrary, since the difference in specific gravity between the bottom-dross and the molten zinc bath is vanishingly small, it is necessary to hold for long time under the condition where the coating bath flow is low in order to sediment the bottom-dross. Especially, it is difficult to sediment the bottom-dross with small size. Moreover, since the bottom-dross deposits on the bottom of the coating tub and may rise again, it is not easy to remove finally the bottom-dross outside the system (removing the bottom-dross from the bottom of the coating tub).

As just described, it is difficult to remove the dross in the coating tub, especially, the bottom-dross which deposits on the bottom of the coating tub. Although the various removal methods were proposed (refer to Patent Documents 1 to 5), the method to readily separate and remove the dross with high removal efficiency is not yet proposed.

[1.4. Relation Between Bath Temperature Fluctuation and Dross Growth]

Figure 2:
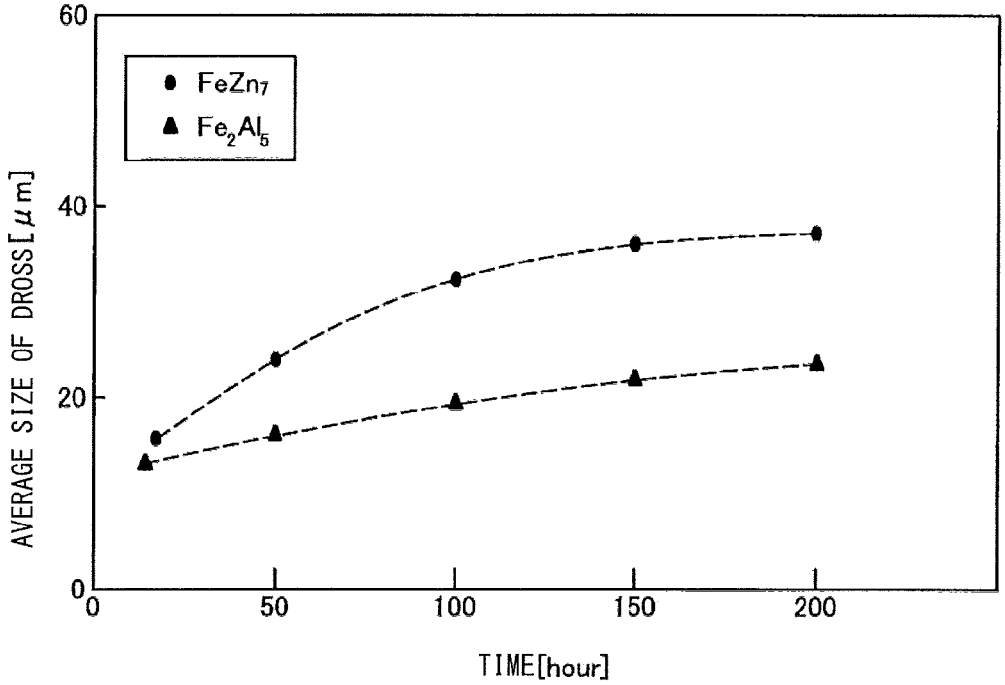
FIG. 2 is a graph which indicates dross growth of each phase under condition where bath temperature is constant.

FIG. 2 is a graph which indicates the dross growth of each phase under the condition where the bath temperature is constant. In the FIG. 2, horizontal axis is the time (hours to days) and vertical axis is the average grain size of dross particles (μm). FIG. 2 indicates the growth of the bottom-dross ($FeZn_7$) which forms in the GA bath and the top-dross ($Fe_2Al_5$) which forms in the GA bath, the GI bath, and the like.

As shown in FIG. 2, when the conditions such as the bath temperature T and the like are constant, a growth rate is slow in each phase of the dross. For example, under the condition where the bath temperature is constant, the bottom-dross ($FeZn_7$) grows only from approximately 15 μm to 20 μm in the average grain size during 200 hours, and the top-dross ($Fe_2Al_5$) grows only from approximately 15 μm to 35 μm during 200 hours.

Next, in reference to Table 1, the result of observation of forming behavior of the dross in case of decreasing the bath temperature will be described. Table 1 shows a state of the dross growth when three types of coating baths A to C in which compositions are different are cooled from 460° C. to 420° C. by a predetermined cooling rate (10° C./sec).

TABLE 1

| TYPE OF COATING BATH | COATING BATH A | COATING BATH B | COATING BATH C |
|---|---|---|---|
| COMPOSITION OF COATING BATH | 0.13 mass % Al<br>0.05 mass % Fe<br>BALANCE: Zn | 0.14 mass % Al<br>0.04 mass % Fe<br>BALANCE: Zn | 0.18 mass % Al<br>0.03 mass % Fe<br>BALANCE: Zn |
| FORMED DROSS AND SIZE THEREOF | $FeZn_7$: 50 μm | $FeZn_7$: 40 μm<br>$Fe_2Al_5$: 10 μm | $Fe_2Al_5$: 5 μm<br>$Fe_2Al_5$: 10 μm<br>$Fe_2Al_5$: 25 μm |

As shown in Table 1, when the bath temperature T decreases from 460° C. to 420° C. by the predetermined cooling rate of 10° C./sec and the unsaturated state is shifted to the supersaturated state in regard to Fe in the coating bath, the rate of formation and growth of the dross is very fast. For example, in the coating bath A (GA bath) with Al of 0.13 mass %, the bottom-dross ($FeZn_7$) with the grain size of approximately 50 μm is formed during only 4 seconds. And, in the coating bath B (GA bath) with Al of 0.14 mass %, the bottom-dross ($FeZn_7$) with the grain size of approximately 40 μm and the top-dross ($Fe_2Al_5$) with the grain size of approximately 10 μm are formed and mixed. Moreover, in the coating bath C (GI bath) with Al of 0.18 mass %, three kinds of the top-dross ($Fe_2Al_5$) with the grain size of approximately 5 μm, 10 μm, and 25 μm are formed.

As mentioned above, under the condition where the bath temperature T is constant (refer to FIG. 2), the growth rates of both the bottom-dross and the top-dross are slow. Thus, if the bath temperature T of the coating bath in the coating tub can be kept constant as much as possible, the dross growth in the coating tub can be suppressed. On the contrary, if the bath temperature T decreases, the unsaturated state is shifted to the supersaturated state in regard to Fe in the coating bath, so that the growth rates of the dross are very fast (refer to FIG. 2). Therefore, by transferring the coating bath of the coating tub to the separating tub and by decreasing the bath temperature T, the top-dross is intentionally precipitated in the coating bath of the separating tub, so that it is possible that the top-dross is effectively separated by the flotation.

[1.5. Relation Between Coating Rate and Dross]

Figure 3A:
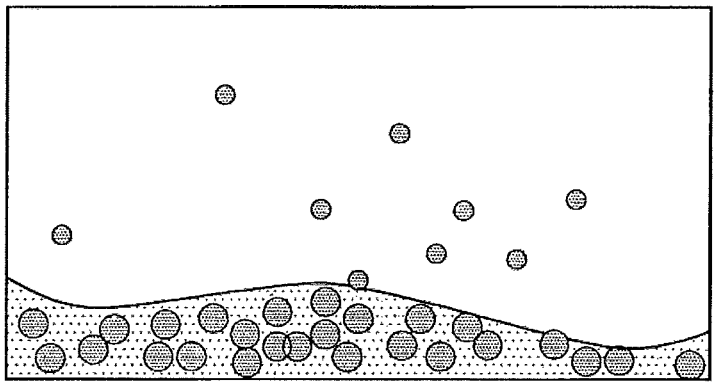
FIG. 3A is a schematic diagram which illustrates a flowing situation of the dross in a coating tub.
Figure 3B:
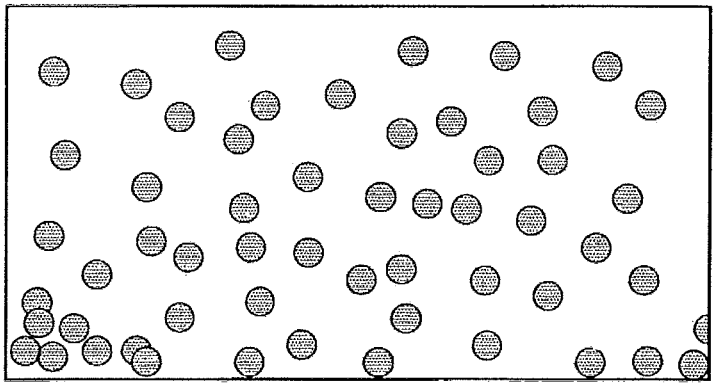
FIG. 3B is a schematic diagram which illustrates a flowing situation of the dross in the coating tub.

FIGS. 3A and 3B are schematic diagrams which illustrate flowing situation of the dross in the GA bath. FIG. 3A shows the situation of normal operation where the coating rate is 150 m/min or less and FIG. 3B shows the situation of operation where the coating rate is high-speed (for example, 200 m/min or more).

Generally, in the GA bath, the bottom-dross forms and the bottom-dross with large size among them sediments and deposits on the bottom of the coating tub in turn. When the coating rate (sheet threading speed of the steel sheet) is slow, for example, less than 100 m/min, the bottom-dross which deposits on the bottom of the tub does not rise due to the coating bath flow. However, when the coating rate is 100 m/min or more, as shown in FIG. 3A, among the bottom-dross, not only the dross with small size but also the dross with medium size which has relatively large diameter rises from the bottom of the tub due to the bath flow which is derived from the sheet threading, and the dross flows in the coating bath of the coating tub. Thus, when an amount of the formation and the deposition of the dross is much in the coating tub, productivity of the coated steel sheet deteriorates. As described above, when the coating rate is 150 m/min or less, the dross with small size and medium size mainly flows in the coating bath.

Moreover, when the coating rate, which is conventionally suppressed (for example, 150 m/min or less) in order to ensure the productivity, is changed to 200 m/min or more for example, as shown in FIG. 3B, all the bottom-dross flows regardless of the grain size. Namely, the bottom-dross cannot deposit on the bottom of the tub by the strong bath flow which is derived from high-speed sheet threading, the dross with large size also flows in the coating bath. In other words, unless it is possible that the dross in the coating bath is almost-completely rendered harmless (dross-free), it is difficult to increase the coating rate.

[1.6. Dross Defects]

The dross defects are defects of the coated steel sheet, are caused by the dross formed in the coating bath, and include appearance deterioration of the coated steel sheet which is derived from dross adhesion, surface defects caused by the dross on roll in the coating bath, and the like, for example. Although it is said that the diameter of the dross which cause the dross defects is 100 μm to 300 μm, the dross defects caused by the dross with very small size such that grain size is approximately 50 μm are observed recently. Therefore, in order to prevent the occurrence of the small dross defects, the dross-free in coating bath is desired.

2. Configuration of Manufacturing Equipment for Galvanized Steel Sheet

Figure 4:
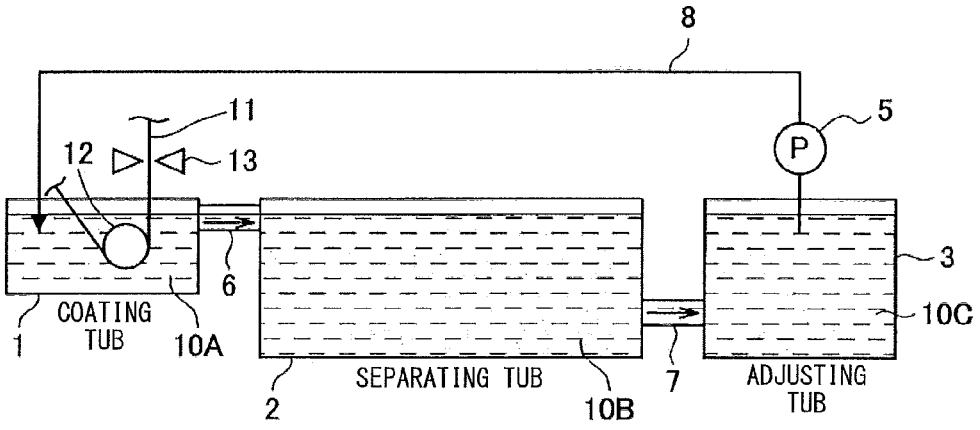
FIG. 4 is a schematic diagram which illustrates a configuration 1 of manufacturing equipment for a galvanized steel sheet according to an embodiment of the present invention.

Next, in reference to FIGS. 4 to 9, the configuration of the manufacturing equipment for the galvanized steel sheet according to the embodiment of the present invention will be described. FIG. 4 is a schematic diagram of the manufacturing equipment for the galvanized steel sheet according to the embodiment, and FIGS. 5 to 8 are schematic diagrams which illustrate modifications 1 to 4 of the embodiment, respectively. FIG. 9 is a schematic diagram which illustrates permissible bath temperature range of each tub in case that the bath temperature of the coating bath 10A which is stored in the coating tub 1 according to the embodiment is 460° C. Hereinafter, the bath temperature and the aluminum concentration of the coating bath which is stored in the coating tub 1 are referred to as T1 and Al respectively. In the same way, the bath temperature and the aluminum concentration of the coating bath which is stored in the separating tub 2 are referred to as T2 and A2 respectively, and the bath temperature and the aluminum concentration of the coating bath which is stored in the adjusting tub 3 are referred to as T3 and A3 respectively.

As shown in FIGS. 4 to 8, the manufacturing equipment for the galvanized steel sheet according to the embodiment (hereinafter, referred to as hot-dip-coating equipment) includes the coating tub 1 to coat the steel sheet 11, the separating tub 2 to separate the dross, and the adjusting tub 3 to adjust the Al concentration of the coating bath 10. In addition, the hot-dip-coating equipment includes circulator to circulate the molten metal (coating bath 10) for coating the steel sheet 11 in order of the coating tub 1—the separating tub 2—the adjusting tub 3—the coating tub 1. The coating bath 10 is the molten metal including at least molten zinc and molten aluminum, and is the GI bath for example. Hereinafter, each configuration of the hot-dip-coating equipment according to the embodiment will be described.

[2.1. Configuration of Circulator of Coating Bath]

First, the circulator will be described. The circulator includes the molten metal transfer apparatus 5 which is concomitantly installed in at least one of the coating tub 1, the separating tub 2, or the adjusting tub 3, and the vessel for the molten metal which connects mutually between the three tubs (for example, communicating vessel 6 or 7, transferring vessel 8, and overflowing vessel 9). The molten metal transfer apparatus 5 may be composed by arbitrary apparatus if the molten metal (coating bath 10) can be transferred. For example, the molten metal transfer apparatus 5 may be mechanical pump and magneto-hydrodynamic pump.

Moreover, the molten metal transfer apparatus 5 may be concomitantly installed in all the tubs of the coating tub 1, the separating tub 2, and the adjusting tub 3, and may be concomitantly installed in arbitrary one tub or two tubs among the three tubs. However, from a viewpoint of simplifying the equipment configuration, it is preferable that the molten metal transfer apparatus 5 is installed in only one tub and the molten metal is transferred between the three tubs by connecting the remaining tubs by the communicating vessel 6 or 7, the transferring vessel 8, the overflowing vessel 9, and the like. In the embodiment of FIGS. 4 to 8, as the molten metal transfer apparatus 5, the mechanical pump which transfers the molten metal is installed in the transferring vessel 8 which is the vessel between the coating tub 1 and the adjusting tub 3. As mentioned later, the coating bath which is transferred from the adjusting tub 3 to the coating tub is the purified coating bath in which the dross is almost removed. Thus, by using the molten metal transfer apparatus 5 only for the purified coating bath, it is possible to minimize trouble of the molten metal transfer apparatus 5 such as dross clogging and the like.

Namely, in the embodiment, the coating tub 1, the separating tub 2, and the adjusting tub 3 are mutually connected by using the vessel such as the communicating vessel 6 or 7, the transferring vessel 8, the overflowing vessel 9, and the like, in order to circulate the coating bath 10. As described above, in case the vessel is used for the bath circulation, it is preferable to suppress erosion of inner wall of the vessel by the bath flow, to prevent a decrease in the temperature and solidification of the bath in the vessel, and the like. Therefor, it is preferable to use the double vessel which equipped with ceramics inside the vessel and to keep warm or heat outer wall of the vessel. Especially, before operating the bath circulation, it is preferable to prevent the solidification of the bath in the vessel by pre-heating the vessel.

[2.2. Overall Structure of Tubs]

Figure 5:
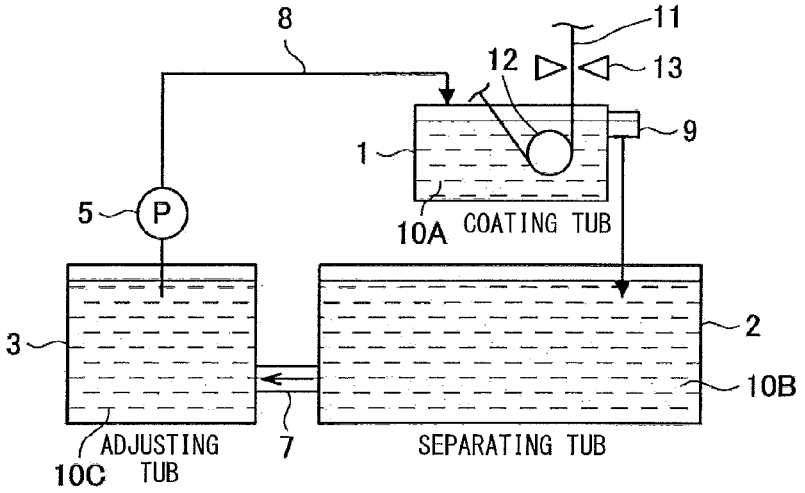
FIG. 5 is a schematic diagram which illustrates a configuration 2 of the manufacturing equipment for the galvanized steel sheet according to modification 1 of the embodiment.
Figure 6:
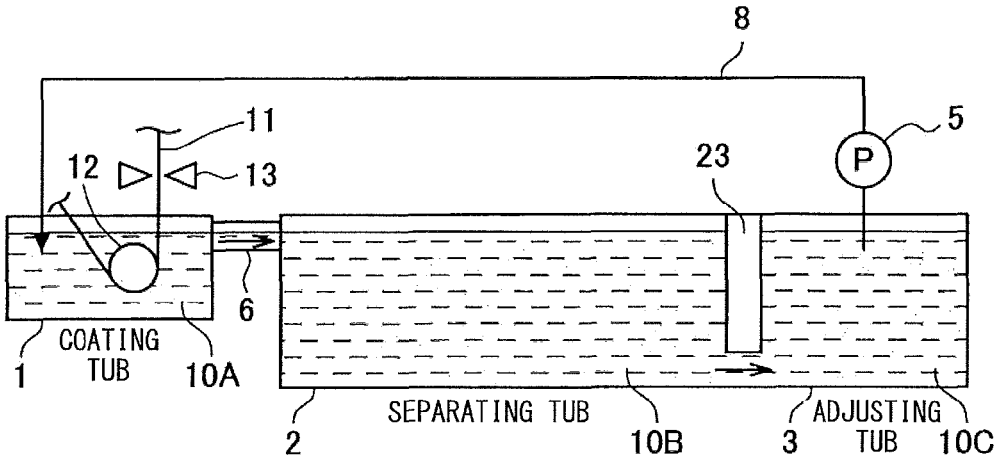
FIG. 6 is a schematic diagram which illustrates a configuration 3 of the manufacturing equipment for the galvanized steel sheet according to modification 2 of the embodiment.
Figure 7:
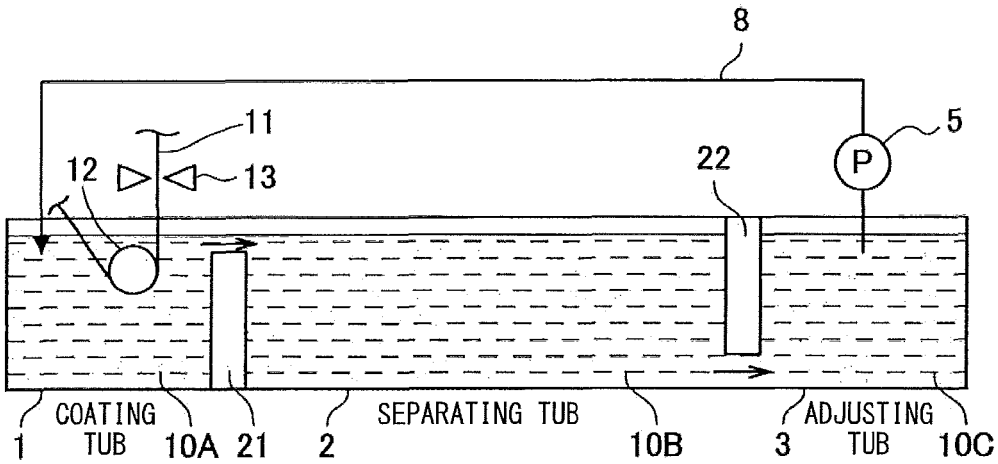
FIG. 7 is a schematic diagram which illustrates a configuration 4 of the manufacturing equipment for the galvanized steel sheet according to modification 3 of the embodiment.

Next, overall configuration of the coating tub 1, the separating tub 2, and the adjusting tub 3 will be described in detail. As shown in FIG. 4, FIG. 5 (modification 1), and FIG. 8 (modification 4), the coating tub 1, the separating tub 2, and the adjusting tub 3 may be the configuration in which the tubs are independent respectively. For example, in the configuration as shown in FIG. 4, the coating tub 1, the separating tub 2, and the adjusting tub 3 are parallelly installed in the horizontal direction, upper parts of the coating tub 1 and the separating tub 2 are connected by the communicating vessel 6, lower parts of the separating tub 2 and the adjusting tub 3 are connected by the communicating vessel 7, and the adjusting tub 3 and the coating tub 1 are connected by the transferring vessel 8 with the molten metal transfer apparatus 5. In this way, it is possible to simplify the overall configuration of the hot-dip-coating equipment by making the height of the bath surface of the coating bath in each tub the same, by circulating the coating bath through the vessels such as the communicating vessel, and by using the molten metal transfer apparatus 5 only at the most downstream. Moreover, in the configuration of the modification 1 as shown in FIG. 5, the overflowing vessel 9 is installed in upper part side of side wall of the coating tub 1, and the coating bath 10A which is overflowed from the coating tub 1 flows down into the separating tub 2 through the overflowing vessel 9.

In addition, the coating tub 1, the separating tub 2, and the adjusting tub 3 may be functionally independent. For example, as shown in the modification 3 in FIG. 7, the coating tub 1, the separating tub 2, and the adjusting tub 3 may be composed by partitioning the inside of single tub with relatively large size into three areas by two weirs 21 and 22, which may be the configuration in which the three tubs are seemingly unified. Moreover, as shown in the modification 2 in FIG. 6, the separating tub 2 and the adjusting tub 3 may be composed by partitioning the inside of the single tub into two areas by one weir 23, the separating tub 2 and the adjusting tub 3 may be unified, and the coating tub 1 may be only independent as the tub configuration. In this way, it is possible to simplify the equipment configuration by unifying three or two tubs among the coating tub 1, the separating tub 2, and the adjusting tub 3.

However, in order to achieve the characteristic dross removal method as mentioned later, in any of the tub component as shown in FIGS. 4 to 8, it is necessary to independently control the bath temperature and the Al concentration of the coating bath in each tub, respectively. Specifically, the bath temperature T1 and Al concentration A1 of the coating bath are controlled at the coating tub 1, the bath temperature T2 and Al concentration A2 of the coating bath are controlled at the separating tub 2, and the bath temperature T3 and Al concentration A3 of the coating bath are controlled at the adjusting tub 3. Thus, temperature controller 1, temperature controller 2, and temperature controller 3 which are not illustrated are respectively installed in each of the coating tub 1, the separating tub 2, and the adjusting tub 3, in order to control the bath temperature T1, T2, and T3 of the coating bath which is stored. The temperature controllers are equipped with heating apparatus and bath temperature control apparatus. The heating apparatus heats the coating bath of each tub, and the bath temperature control apparatus controls operation of the heating apparatus. Thus, the bath temperature of the coating tub 1, the separating tub 2, and the adjusting tub 3 are respectively controlled to the predetermined temperature T1, T2, and T3, by the temperature controller 1, the temperature controller 2, and the temperature controller 3. In addition, although the sample for aluminum concentration measurement of each tub may be periodically sampled by manpower, it is preferable to respectively equip aluminum concentration analyzer at each tub, in order to independently control the A1 concentration of the coating bath in each tub. The aluminum concentration analyzer is composed by sampler for the sample of the aluminum concentration measurement, sensor of the aluminum concentration of the molten metal or alloy, or the like. The aluminum concentration of the sample which is sampled by the sampler may be periodically measured by chemical analyzer, or the aluminum concentration of the coating bath may be continuously measured by the sensor of the aluminum concentration. Based on the results of the aluminum measurement, the Al concentration of the coating bath in each tub is independently controlled by controlling the circulating volume or by supplying first or second zinc-included-metal.

Moreover, in all the embodiment of FIGS. 4 to 8, the coating bath 10A flows out from coating bath outlet which is made by the communicating vessel 6, the overflowing vessel 9, and the weir 21 and which is located on the upper part of the coating tub 1 and downstream side of running direction of the steel sheet 11, and the coating bath 10A flows into the separating tub 2. This is effective in that the entire coating bath 10A can be circulated without stagnation of the coating bath 10A in the coating tub 1 by using the flow of the coating bath 10A which is derived from the running of the steel sheet 11. Furthermore, in all the embodiment of FIGS. 4 to 8, the communicating vessel 7 and the weirs 22 and 23 are installed so that the coating bath 10B which flows out from the lower part of the separating tub 2 flows into the adjusting tub 3. Since the top-dross is separated by the flotation at the separating tub 2 as described later, the upper part of the coating bath 10B in the separating tub 2 contains the top-dross by high density as compared with the lower part. Thus, by transferring the coating bath 10B of the lower part of the separating tub 2 to the adjusting tub 3, the coating bath 10B of the lower part where the content percentage of the top-dross is low can be transferred to the adjusting tub 3, so that the dross removal efficiency increases.

[2.3. Configuration of Each Bath]

Next, the configuration of each bath of the coating tub 1, the separating tub 2, and the adjusting tub 3 will be described.

(1) Coating Tub

First, the coating tub 1 will be described. As shown in FIGS. 4 to 8, the coating tub 1 has the functions of (a) storing the coating bath 10A which includes the molten metal at the predetermined bath temperature T1, and (b) coating the steel sheet 11 which is dipped in the coating bath 10A. The coating tub 1 is the tub in which the steel sheet 11 is actually dipped in the coating bath 10A and in which the steel sheet 11 is coated by the molten metal. The composition and the bath temperature T1 of the coating bath 10A in the coating tub 1 are maintained within the proper range according to the kind of the coated steel sheets for manufacture. For example, in case that the coating bath 10A is the GI bath, as shown in FIG. 9, the bath temperature T1 of the coating tub 1 is kept at approximately 460° C. by the temperature controller 1.

In the coating bath 10A of the coating tub 1, the roll in the coating bath such as sink roll 12, support roll (not illustrated), and the like is installed, and gas wiping nozzle 13 is installed above the coating tub 1. The steel sheet 11 with strip-shaped to be coated enters obliquely downward into the coating bath 10A of the coating tub 1, traveling direction is changed by the sink roll 12, the steel sheet 11 is pulled up vertically upward from the coating bath 10A, and excessive molten metal on the surface of the steel sheet 11 is wiped by the gas wiping nozzle 13.

Moreover, it is preferable that storage Q1 [ton] (capacity of the coating tub 1) of the coating bath 10A in the coating tub 1 is 5 times or less of circulating volume q [ton/hour] of the coating bath 10 per one hour by the circulator. When the storage Q1 of the coating bath 10A is more than 5 times of the circulating volume q, stagnation time of the coating bath 10A in the coating tub 1 is prolonged, so that possibility of the formation and growth of the dross in the coating bath 10A increases. Thus, by controlling the storage Q1 of the coating bath 10A to be 5 times or less of the circulating volume q, it is possible that the stagnation time of the coating bath 10A in the coating tub 1 is controlled to be predetermined time or shorter. In the conditions, when Fe is dissolved in the coating bath 10A of the coating tub 1 from the steel sheet 11, the dross is not formed in the coating bath 10A, or, even if the dross is formed, the coating bath 10A which contains the dross flows out to the separating tub 2 before the dross grows up to the harmful size. However, it is preferable that the capacity Q1 of the coating tub 1 is as small as possible, because the coating bath 10A may stagnate in the tub and the dross may grow up to the harmful size at the stagnation area depending on the shape of the coating tub 1.

In addition, during the operation of the hot-dip-coating, part of the coating bath 10A in the coating tub 1 continuously flows out to the separating tub 2 from the coating bath outlet which is made by the communicating vessel 6, the overflowing vessel 9, and the weir 21. And, part of the coating bath 10C flows into the coating tub 1 through the transferring vessel 8 and the like from the adjusting tub 3 as mentioned later. It is preferable that the position where the coating bath 10C flows into the coating tub 1 is located on upstream side of the running direction of the steel sheet 11 and that the position of the coating bath outlet where the coating bath 10A flows out to the separating tub 2 is located on the upper part of the coating tub 1 and the downstream side of the running direction of the steel sheet 11. Thereby, the local stagnation area of the coating bath 10A in the coating tub 1 is hard to form. Thus, it can be suppressed that the dross grows up to the harmful size at the local stagnation area in the coating tub 1. Here, the upstream side of the running direction of the steel sheet 11 is the side including the entering position of the steel sheet 11 in case of longitudinally-halving the coating tub 1 so as to separate the entering position and the pulling up position of the steel sheet 11.

Similarly, the downstream side of the running direction of the steel sheet 11 is the side including the pulling up position of the steel sheet 11 in case of longitudinally-halving the coating tub 1.

(2) Separating Tub

Next, the separating tub 2 will be described. As shown in FIGS. 4 to 8, the separating tub 2 has the functions of (a) storing the coating bath 10B which is transferred from the coating tub 1 at bath temperature T2 which is lower than the bath temperature T1 of the coating bath 10A in the coating tub 1, (b) precipitating the top-dross by supersaturating Fe in the coating bath 10B and removing the precipitated top-dross by the flotation separation. Since the Al concentration of the GI bath is originally higher than that of the GA bath, the state (bath temperature and composition) of the coating bath 10B in the separating tub 2 becomes the top-dross formation range only by controlling the bath temperature T2 of the separating tub 2 to be lower than the bath temperature T1 of the coating tub 1.

For example, in case that the coating bath 10 is the GI bath, as shown in FIG. 9, the bath temperature T2 of the separating tub 2 is kept at the temperature which is lower 5° C. or more as compared with the bath temperature T1 of the coating tub 1 and is higher than the melting point M (for example, melting point of 420° C. of the GI bath) of the molten metal which is the coating bath 10 (for example, 420° C.≤T2≤T1−5° C.). Thereby, it is possible that only the top-dross is intentionally precipitated in the separating tub 2 without precipitating the bottom-dross in the coating bath 10B by transferring the coating bath 10 from the coating tub 1 to the separating tub 2 and by decreasing the bath temperature T2. Thus, the top-dross can be suitably removed by the flotation separation utilizing the difference in specific gravity.

The principle will be described in detail. Fe which is dissolved from the steel sheet 11 is included in the coating bath 10A which flows into the separating tub 2 from the coating tub 1. The solubility limit of Fe decreases with the decrease in the bath temperature T (from T1 to T2). Thereby, Fe becomes the supersaturated state in the coating bath 10B of the separating tub 2, so that the dross which is equivalent to the amount of the supersaturated Fe is precipitated. In case that the coating bath 10 is the GI bath, the dross which is precipitated in the separating tub 2 by decreasing the bath temperature T almost becomes the top-dross. As shown in FIG. 1, since the A1 concentration of the GI bath is 0.15 to 0.25 mass % and is higher than that of the GA bath, the state (bath temperature and composition) of the coating bath 10B in the separating tub 2 becomes the top-dross formation range only by controlling the bath temperature T2 of the separating tub 2 to be lower than the bath temperature T1 of the coating tub 1. Thus, the dross which is formed in the GI bath is only the top-dross and the bottom-dross hardly forms. In other words, since the Al concentration A2 of the coating bath 10B (GI bath) in the separating tub 2 is higher than 0.14 mass % which is the top-dross formation range, the dross which is formed in the separating tub 2 is only the top-dross.

As mention above, by precipitating only the top-dross in the coating bath 10B of the separating tub 2, the specific gravity of the dross which precipitates in the coating bath 10B becomes smaller than the specific gravity of the molten metal (coating bath 10). Therefore, it is possible that the top-dross is suitably separated by the flotation and easily removed at the separating tub 2.

In addition, the bath temperature T2 of the separating tub 2 is decreased to be lower than the bath temperature T1 of the coating tub 1 in order to supersaturate Fe in the bath, and the bath temperature T2 of the separating tub 2 is controlled to be higher than the melting point M of the molten metal in order to avoid the solidification of the coating bath 10B.

As mentioned above, a large amount of the top-dross is intentionally formed in the coating bath 10B at the separating tub 2 by decreasing the bath temperature T of the coating bath 10. Since the top-dross rises to top surface of the coating bath 10B by the difference in specific gravity compared with the coating bath 10B and is trapped at the top surface, the flotation separation of the top-dross needs the time to a certain extent. Thus, it is preferable that storage Q2 [ton] (capacity of the separating tub 2) of the coating bath 10B in the separating tub 2 is 2 times or more of the circulating volume q [ton/hour] of the coating bath 10 per one hour by the circulator. Thereby, it is possible to sufficiently remove the top-dross at the separating tub 2, because the time for the flotation separation which is averagely 2 hours or more is obtained from the inflow of the coating bath 10 which flows into the separating tub 2 from the coating tub 1 to the outflow into the adjusting tub 3. When the storage Q2 of the coating bath 10B in the separating tub 2 is less than 2 times of the circulating volume q of the coating bath 10 per one hour, the time for the flotation separation of the top-dross is not sufficiently obtained, so that the dross removal efficiency decreases.

In addition, during the operation of the hot-dip-coating, the part of the coating bath 10A continuously flows into the separating tub 2 from the coating tub 1 through the communicating vessel 6, the overflowing vessel 9, and the like, and the part of the coating bath 10B in the separating tub 2 continuously flows out to the adjusting tub 3 through the communicating vessel 7 and the like.

(3) Adjusting Tub

Next, the adjusting tub 3 will be described. As shown in FIGS. 4 to 8, the adjusting tub 3 has the functions of (a) storing the coating bath 10C which is transferred from the separating tub 2 at bath temperature T3 which is higher than the bath temperature T1 of the coating tub 1 and the bath temperature T2 of the separating tub 2, (b) dissolving the dross which is contained in the coating bath 10C by controlling Fe of the coating bath 10C to be the unsaturated state, and (c) adjusting the bath temperature T3 and the Al concentration A3 of the coating bath 10C which is transferred to the coating tub 1 in order to keep constantly the bath temperature T1 and Al concentration A1 of the coating tub 1.

The adjusting tub 3 is the tub in which a metal (correspond to the first zinc-included-metal or the second zinc-included-metal) is supplied and melted in order to supply the molten metal which is consumed at the coating tub 1. The adjusting tub 3 also has the functions of reheating the bath temperature T which was lowered in the separating tub 2. Moreover, in case of increasing the Al concentration A2 of the bath in the separating tub 2 by supplying the metal with high Al concentration (first zinc-included-metal) to the separating tub 2 (refer to FIG. 10 as explained below), the adjusting tub 3 also has the functions of decreasing and optimizing the Al concentration of the bath by supply the metal with low Al concentration (second zinc-included-metal).

In order to decrease the Al concentration of the coating bath 10 in the adjusting tub 3, the zinc-included-metal which includes Al with the concentration lower than the A1 concentration A2 of the coating bath 10B in the separating tub 2 or the zinc-included-metal which does not include Al may be supplied and melted in the coating bath 10C of the adjusting tub 3 as the second zinc-included-metal. By supplying the metal with low Al concentration, the Al concentration A3 of the coating bath 10C which is transferred from the adjusting tub 3 to the coating tub 1 is preferably controlled (A2>A3>A1), so that it is possible that the Al concentration A1 of the coating bath 10A in the coating tub 1 is kept constantly to the proper concentration which is suitable for the composition of the intended GI bath. For example, in the GI bath, the Al concentration A1 of the coating bath 10A in the coating tub 1 is controlled to the constant concentration within the range of 0.15 to 0.25 mass %.

On the contrary, in case of not supplying any zinc-included-metal to the separating tub 2 (refer to FIG. 11 as explained below), the molten metal (Al and Zn) which is consumed at the coating tub 1 may be supplied by supplying the zinc-included-metal (first zinc-included-metal) which includes Al with the concentration higher than the Al concentration A1 of the coating bath 10A in the coating tub 1. In the case, the adjusting tub 3 also has the functions of increasing and optimizing the Al concentration of the bath and of supplying Zn into the system by supply the zinc-included-metal (first zinc-included-metal) with high Al concentration.

Moreover, it is necessary to control the bath temperature T3 of the adjusting tub 3 by the temperature controller 3 to the temperature range which does not cause the problem even if the coating bath 10C flows into the coating tub 1. Thus, as shown in FIG. 9, it is preferable that the bath temperature T3 is controlled within ±10° C. on the basis of the temperature in which the difference of the bath temperature decrease $\Delta T_{fall}$ is added to the bath temperature T1 of the coating tub 1 ($T1+\Delta T_{fall}-10°\ C. \leq T3 \leq T1+\Delta T_{fall}+10°\ C.$). Here, the difference of the bath temperature decrease $\Delta T_{fall}$ is the value of the bath temperature decrease of the coating bath 10 which occurs naturally when the coating bath 10C is transferred from the adjusting tub 3 to the coating tub 1. When the bath temperature T3 of the adjusting tub 3 does not satisfy the temperature range, the bath temperature deviation in the coating tub 1 increases, so that the formation and growth of the dross in the coating tub 1 are promoted. Moreover, the bath temperature T4 of the coating bath 10C at the inlet of the coating tub 1 becomes within the range of ±10° C. on the basis of the bath temperature T1 of the coating tub 1 ($T1-10°\ C. \leq T4 \leq T1+10°\ C.$).

Furthermore, in order to dissolve the residual dross with small size which is not able to be removed in the separating tub 2 in the coating bath 10C, it is preferable that the bath temperature T3 of the adjusting tub 3 is controlled to be higher 5° C. or more as compared with the bath temperature T2 of the separating tub 2 ($T3 \geq T2+5°\ C.$). Although the bath temperature T1, T2, and T3 of each tub are controlled by an induction heating apparatus and the like, the bath temperature fluctuation of approximately ±3° C. in general is inevitable because of the limitation of control accuracy. In consideration of the situation of the control accuracy, that is the maximum (+3° C. from the targeted bath temperature) and the minimum (−3° C. from the targeted bath temperature) of the bath temperature fluctuation, it is preferable that the bath temperature T3 (targeted value) of the adjusting tub 3 is higher at least 5° C. or more as compared with the bath temperature T2 (targeted value) of the separating tub 2. Thereby, it is possible that Fe of the coating bath 10C in the adjusting tub 3 is the unsaturated state. Namely, it is possible that the residual dross with small size which is contained in the coating bath 10B transferred from the separating tub 2 is certainly dissolved and removed in the adjusting tub 3. When the temperature difference between the bath temperature T3 and T2 is less than 5° C., unsaturated degree of Fe is insufficient, so that the residual dross which flows into the adjusting tub 3 from the separating tub 2 cannot be sufficiently dissolved.

In addition, storage Q3 [ton] (capacity of the adjusting tub 3) of the coating bath 10C in the adjusting tub 3 is arbitrary and is not limited in particular, if melting the metal, keeping the bath temperature T3, and transferring the bath to the coating tub 1 are possible.

By the way, when the metal with low Al concentration (the first zinc-included-metal or the second zinc-included-metal) is supplied into the adjusting tub 3, the bath temperature decreases locally to the melting point of the metal at minimum around the metal which is dipped into the coating bath 10C of the adjusting tub 3, so that the dross forms. Since Fe is the unsaturated state in the coating bath 10 of the adjusting tub 3, the formed dross is dissolved relatively promptly, so that the dross is harmless in general. However, depending on the unsaturated degree of Fe in the adjusting tub 3 and the time to melt the metal, the formed dross may be undissolved in the coating bath 10C and may flow out to the coating tub 1.

Figure 8:
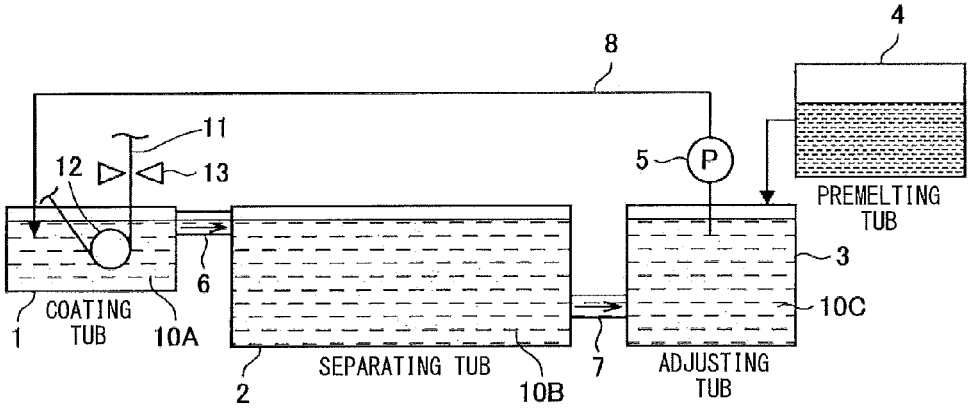
FIG. 8 is a schematic diagram which illustrates a configuration 5 of the manufacturing equipment for the galvanized steel sheet according to modification 4 of the embodiment.
Figure 9:
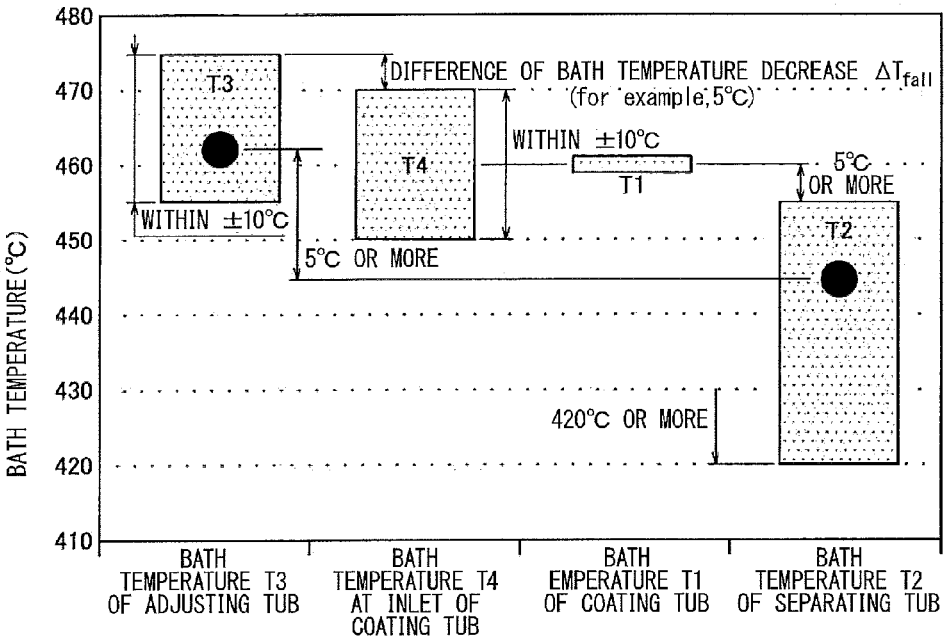
FIG. 9 is a schematic diagram which illustrates permissible bath temperature range of each tub according to the embodiment when the bath temperature of the coating tub is 460° C.

Thus, in the above case, as shown in the modification 4 in FIG. 8, the premelting tub 4 may be installed in addition to the adjusting tub 3, and the molten metal which is obtained by melting the metal in the premelting tub 4 may be supplied to the adjusting tub 3. Thereby, it is possible to supply the molten metal which is preheated to approximately the bath temperature T3 at the premelting tub 4 to the adjusting tub 3 and to prevent the temperature of the coating bath 10C in the adjusting tub 3 from decreasing locally. Namely, it is possible to avoid the problem such that the dross forms by supplying the metal at the adjusting tub 3.

In addition, during the operation of the hot-dip-coating, the part of the coating bath 10B continuously flows into the adjusting tub 3 from the separating tub 2 through the communicating vessel 7 and the like, and the part of the coating bath 10C in the adjusting tub 3 continuously flows out to the coating tub 1 through the transferring vessel 8 and the like.

3. Manufacturing Method of Galvanized Steel Sheet

Figure 10:
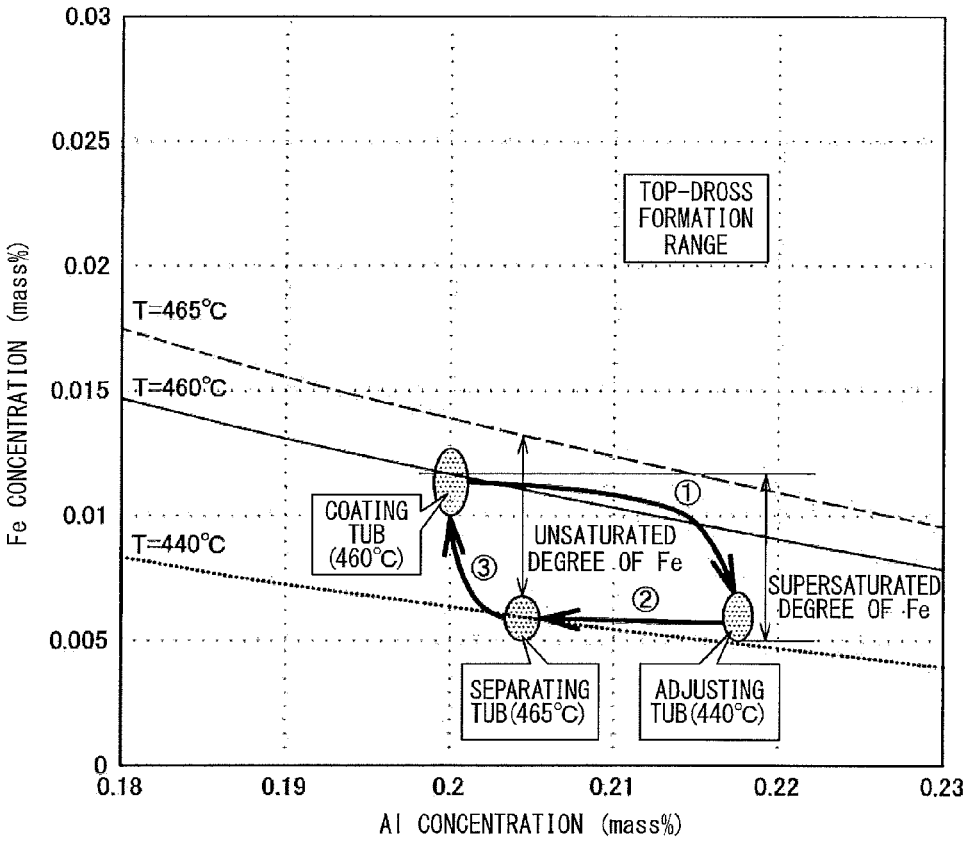
FIG. 10 is the ternary phase diagram which indicates state transition of the coating bath in each tub according to the embodiment.

Next, in reference to FIG. 10, coating method of the steel sheet 11 by using the hot-dip-coating equipment as mentioned above (that is, the manufacturing method of the galvanized steel sheet) will be described. FIG. 10 is the ternary phase diagram which indicates state transition of the coating bath 10 (GI bath) in each tub according to the embodiment.

In the manufacturing method of the galvanized steel sheet according to the embodiment, the coating bath 10 (GI bath) is circulated by the circulator which includes the molten metal transfer apparatus 5, the vessel, and the like in order of the coating tub 1 (for example, bath temperature: 460° C., Al concentration: approximately 0.200 mass %), the separating tub 2 (for example, bath temperature: 440° C., Al concentration: approximately 0.217 mass %), and the adjusting tub 3 (for example, bath temperature: 465° C., Al concentration: approximately 0.205 mass %). And the following processes are simultaneously and parallelly conducted in each tub of the coating tub 1, the separating tub 2, and the adjusting tub 3.

(1) Coating Process at the Coating Tub 1

First, in the coating tub 1, the coating bath 10A which is stored in the coating tub 1 is kept at the predetermined bath temperature T1, and the steel sheet 11 which is dipped in the coating bath 10A is coated. In the coating process, the coating bath 10C which is transferred from the adjusting tub 3 flows into the coating tub 1, and the part of the coating bath 10A flows out from the coating tub 1 to the separating tub 2. In the coating tub 1, since the steel sheet 11 is continuously dipped in the coating bath 10A and Fe is dissolved from the steel sheet 11 and is sufficiently supplied to the coating bath 10A, the Fe concentration reaches approximately the saturated concentration.

However, as mentioned above, the stagnation time of the coating bath 10A in the coating tub 1 is short time (for example, 5 hours or less on average). Thus, even if operational fluctuation such as the bath temperature fluctuation occurs to a certain extent, the dross does not form until the Fe concentration of the coating bath 10A reaches the saturation point. Moreover, even if the dross forms, the dross is only small size and does not grow up to the large harmful size. Furthermore, since the coating tub 1 is miniaturized as compared with the conventional coating tub, the stagnation time of the circulating coating bath 10 in the coating tub 1 is shortened. Therefore, it is possible that the dross growth to the harmful size in the coating tub 1 is certainly avoided.

(2) Separating Process at the Separating Tub 2

Next, the circulation bath which flows out from the coating tub 1 led to the separating tub 2. In the separating tub 2, the bath temperature T2 of the coating bath 10B which is stored in the separating tub 2 is kept at the temperature which is lower 5° C. or more as compared with the bath temperature T1 of the coating tub 1, and the Al concentration A2 of the coating bath 10B is controlled to the concentration higher than Al concentration A1 of the coating bath in the coating tub 1. In the separating tub 2, Fe which is supersaturated in the coating bath 10B is precipitated as the top-dross.

For example, as shown in FIG. 10, when the coating bath 10A of the coating tub 1 is transferred to the separating tub 2, the bath temperature T decreases drastically from T1 (460° C.) to T2 (440° C.), and the Al concentration increases from Al (approximately 0.200 mass %) to A2 (approximately 0.217 mass %). As the results, Fe becomes the supersaturated state in the coating bath 10B of the separating tub 2, so that the excessive Fe in the coating bath 10B of the separating tub 2 is precipitated as the top-dross ($Fe_2Al_5$). As explained in Table 1, the dross forms easily when the bath temperature decreases. In the embodiment of the GI bath of FIG. 10, Fe in the coating bath 10 transferred from the coating tub 1 to the separating tub 2 becomes the supersaturated state by the decrease in the bath temperature T, so that a large amount of the top-dross is formed in the separating tub 2, depending on the super saturated degree. At the time, the Al concentration A2 of the coating bath 10B is, for example, 0.14 mass % or more, which is the high concentration where the state of the coating bath 10B becomes the top-dross formation range under the condition of the bath temperature T2, so that the top-dross only forms and the bottom-dross hardly forms. Thus, the top-dross which precipitates in the coating bath 10B of the separating tub 2 rises to top surface of the coating bath 10B of the separating tub 2 by the difference in specific gravity compared with the coating bath 10B (molten zinc bath), and the dross is separated and removed. In addition, the Fe concentration of the coating bath 10B at the outlet of the separating tub 2 is slightly higher concentration than the saturation point of the Fe concentration, because the residual dross with small size which is not completely separated in the separating tub 2 is contained.

Since the capacity Q2 of the separating tub 2 is sufficiently large as compared with the circulating volume q of the bath and the stagnation time of the coating bath in the separating tub 2 is 2 hours or more, most of the top-dross is separated by the flotation and removed outside the system. Moreover, in order to control the Al concentration A2 of the bath in the separating tub 2 to be, for example, 0.14 mass % or more, small amount of the metal with high Al concentration (first zinc-included-metal) which includes Al with the concentration higher than the Al concentration A1 of the bath in the coating tub 1 is supplied and melted in the separating tub 2.

(3) Dissolving Process of Dross and Adjusting Process of Bath Temperature and Al Concentration at the Adjusting Tub 3

Furthermore, the circulation bath which flows out from the separating tub 2 is led to the adjusting tub 3. In the adjusting tub 3, the bath temperature T3 of the adjusting tub 3 is kept at the temperature which is higher 5° C. or more as compared with the bath temperature T2 of the separating tub 2, and the Al concentration A3 of the adjusting tub 3 is controlled to be higher than the Al concentration A1 of the coating tub 1 and lower than the Al concentration A2 of the separating tub 2. In the adjusting tub 3, the dross which is contained in the coating bath 10C is dissolved by controlling Fe of the coating bath 10C to be the unsaturated state. Thereby, it is possible that the top-dross with small size (residual dross) which cannot be separated in the separating tub 2 is dissolved and removed in the coating bath 10C in which Fe is the unsaturated state.

For example, as shown in FIG. 10, when the coating bath 10B in which the top-dross is separated in the separating tub 2 is transferred to the adjusting tub 3, the bath temperature T increases drastically from T2 (440° C.) to T3 (465° C.), and the Al concentration decreases from A2 (approximately 0.217 mass %) to A3 (approximately 0.205 mass %). As the results, Fe becomes exceedingly the unsaturated state in the coating bath 10C of the adjusting tub 3, so that the top-dross ($Fe_2Al_5$) with small size which is residual in the bath is decomposed (dissolved) into Fe and Al relatively promptly and disappears. In this way, in case of dissolving the residual dross, the coating bath 10C of the adjusting tub 3 is still the state in which Fe is unsaturated.

In addition, the metal with low Al concentration (second zinc-included-metal) which is to supply the molten metal which is consumed at the coating tub 1 is supplied and melted in the coating bath 10C of the adjusting tub 3. In case that the dross which forms by melting the metal causes the problem, as shown in FIG. 8, the premelting tub 4 may be installed beside the adjusting tub 3, and the molten metal which is melted in the premelting tub 4 may be supplied to the adjusting tub 3. Moreover, since the metal with high Al concentration (first zinc-included-metal) is supplied to the separating tub 2, the Al concentration of the circulation bath becomes excessive high concentration. Thus, the second zinc-included-metal which is supplied to the adjusting tub 3 is the zinc-included-metal with Al concentration lower than the aluminum concentration A3 of the coating bath 10B in the separating tub 2 or the zinc-included-metal which does not include Al. By supplying the second zinc-included-metal with low Al concentration, the Al concentration A3 of the bath in the adjusting tub 3 decreases to be lower than the Al concentration A2 of the separating tub 2 and is controlled to the concentration which is suitable to keep constantly the Al concentration A1 of the coating tub 1.

Thereafter, the coating bath 10C of the adjusting tub 3 in which the dross is almost not contained and Fe is the unsaturated state is led to the coating tub 1 and is utilized for the coating process as described in above (1). While the coating bath 10C is transferred from the adjusting tub 3 to the coating tub 1, the bath temperature T decreases naturally by the difference of the bath temperature decrease $\Delta T_{fall}$ as described above. In the coating bath 10C which is transferred from the adjusting tub 3 to the coating tub 1, the dross is almost not contained and Fe is the unsaturated state. However, since Fe is dissolved in the coating bath 10A from the steel sheet 11 which is dipped in the coating tub 1, the Fe concentration of the bath reaches gradually approximately 0.012 mass % which is the saturation point at the bath temperature T1 (460° C.). Moreover, in the coating tub 1, Al is consumed by reacting the steel sheet 11 and the coating bath 10A. Thus, even if the coating bath 10C with relatively high Al concentration A3 (approximately 0.205 mass %) is transferred from the adjusting tub 3 to the coating tub 1, the Al concentration A1 of the coating tub 1 hardly increases and keep at nearly constant value (approximately 0.200 mass %).

Moreover, the coating tub 1 is miniaturized as mentioned above, and the stagnation time of the circulating coating bath 10 in the coating tub 1 is short. Thus, even if the operational fluctuation such as the bath temperature fluctuation occurs to a certain extent in the coating tub 1, the top-dross is not formed in the coating tub 1 until the Fe concentration of the coating bath 10A reaches the saturation point (for example, 0.012 mass %). Moreover, even if the Fe concentration of the bath in the coating tub 1 reaches the saturation point and the dross with small size forms, the formed dross does not grow up to the harmful size (for example, 50 μm or more) during the short stagnation time (for example, several hours) in the coating tub 1, because the dross hardly grows under the condition where the bath temperature is constant (refer to FIG. 2). The dross with small size which forms in the coating tub 1 is transferred to the separating tub 2 before the dross grows up to the harmful size, and is removed by the flotation separation.

Moreover, the Fe concentration of the coating bath 10A in the coating tub 1 varies depending on, for example, the capacity Q1 of the coating tub 1, the circulating volumes q, dissolvability of Fe, and the like. Thus, Fe of the coating bath 10A can be the unsaturated state (in case that the Fe concentration is less than 0.012 mass %). In the case, since Fe is unsaturated, the dross hardly forms. Contrary, Fe of the coating bath 10A also can be slightly the supersaturated state (in case that the Fe concentration is slightly more than 0.012 mass %). In the case, since the dross which forms in the coating bath 10A within short time is the small size, the problem such as the dross defects does not occur.

As explained above, by circulating the coating bath 10 in order of the coating tub 1, the separating tub 2, and the adjusting tub 3, it is possible that the dross which forms inevitably in the coating bath during the manufacture of the galvanized steel sheet is removed and is almost-completely rendered harmless. Therefore, the coating bath 10A of the coating tub 1 can be continuously controlled to the dross-free state. Moreover, the problems such as the appearance deterioration of the surface of the steel sheet caused by the dross adhesion, surface defects caused by the dross, the roll-slipping caused by the dross precipitation on the surface of the roll in the coating bath, and the like are solvable. When performing the dross removal by using the manufacturing equipment according to the embodiment, it is unnecessary to stop the sheet threading of the coated steel sheets. The coating bath 10 is circulated in order of the coating tub 1, the separating tub 2, and the adjusting tub 3 with the sheet threading. Namely, the dross is removed by not the batch processing but the consecutive processing. Therefore, the coating bath 10A of the coating tub 1 can be continuously controlled to the dross-free and clean state.

Next, in reference to FIG. 10, method of adjusting the Al concentration of the coating bath 10 by supplying the metal to the coating bath 10 which is circulated between the tubs will be described.

The Al concentration in the coating layer of the galvanized steel sheets (GI) is, for example, 0.3 mass % on average, and is higher than the Al concentration A1 (0.200 mass %) of coating bath 10A in the coating tub 1. Namely, Al of the coating bath 10A is concentrated and coated to the coating layer of the steel sheet 11. Therefore, if the Al concentration of the metal which is supplied to the coating bath 10 is 0.200 mass %, the Al concentration of the coating bath 10A decreases gradually. Thus, in the conventional supply of the metal which is spot-like, Al concentration is maintained by supplying the metal with Al concentration of 0.3 to 0.6 mass % directly to the coating tub.

In the hot-dip-coating equipment according to the embodiment, the coating bath 10 is continuously transferred from the adjusting tub 3 to the coating tub 1. In order to control the Al concentration A1 of the coating tub 1 to be 0.200 mass % for example, it is necessary to keep supplying the coating bath 10 in which the Al concentration is higher than 0.200 mass % (for example, 0.205 mass %) to the coating tub 1 from the adjusting tub 3. Thus, in order to control the Al concentration A3 of the adjusting tub 3 to be approximately 0.205 mass % which is the target, the Al concentration A2 of the separating tub 2 is kept at high concentration (for example, 0.217 mass %) which is higher than A3 by supplying intentionally Al to the separating tub 2. Moreover, in the separating tub 2, in order that the large amount of the top-dross is precipitated and separated by the flotation, it is preferable that the Al concentration A2 of the bath in the separating tub 2 is controlled to high concentration. Therefore, the metal with high Al concentration (for example, 10 mass % Al-90 mass % Zn) as the first zinc-included-metal is supplied into the separating tub 2, and the Al concentration A2 of the coating bath 10B in the separating tub 2 is controlled to high. Here, the amount of Al supplied to the separating tub 2 is equivalent to the total of the amount of Al consumed as the top-dross at the separating tub 2 and the amount of Al consumed as the coating layer of the steel sheet 11 at the coating tub 1.

On the other hand, in the adjusting tub 3, the metal with low Al concentration and high Zn concentration (for example, the zinc-included-metal which is 0.1 mass % Al—Zn or the zinc-included-metal which does not contain Al) as the second zinc-included-metal is supplied. Thereby, the Al concentration of the coating bath 10B transferred from the separating tub 2 to the adjusting tub 3 decreases, and the Al concentration A3 of the coating bath 10C in the adjusting tub 3 is controlled to approximately the Al concentration (for example, 0.205 mass %) which is intermediate value of the Al concentration A2 of the separating tub 2 and the Al concentration A1 of the coating tub 1. By transferring the coating bath 10C from the adjusting tub 3 to the coating tub 1, the Al concentration A1 of the bath in the coating tub 1 can be controlled to the proper concentration (for example, 0.200 mass %) which is suitable for manufacturing the GI.

As described above, in the hot-dip-coating equipment according to the embodiment, the supply of the coating bath and the composition of the coating bath, for example, the Al concentration, are controlled by supplying the metal to the separating tub 2 and the adjusting tub 3. Therefore, it is not necessary to supply the metal directly to the coating tub 1, so that it is possible to prevent the dross from forming by the change of the bath temperature around the metal.

Figure 11:
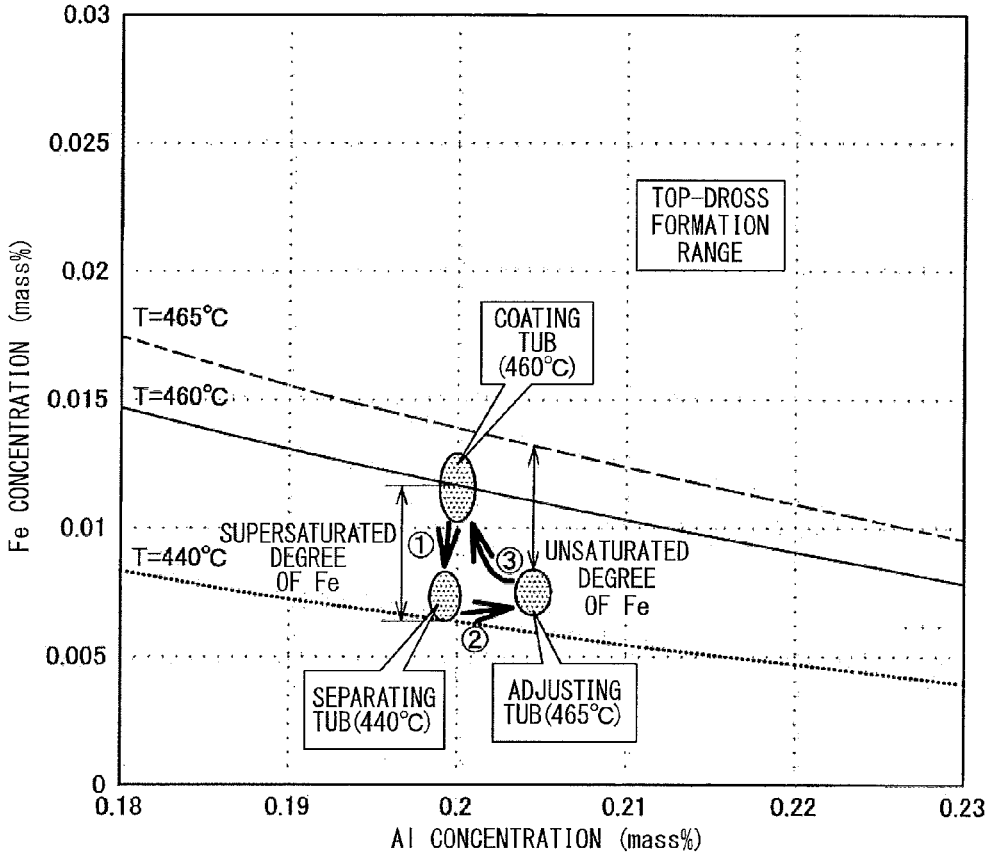
FIG. 11 is the ternary phase diagram which indicates the state transition of the coating bath in each tub according to modification of the embodiment.

Next, in reference to FIG. 11, the modification of the manufacturing method of the galvanized steel sheet according to the embodiment will be described. FIG. 11 is the ternary phase diagram which indicates the state of the GA bath according to the embodiment. FIG. 11 is the ternary phase diagram which indicates the state transition of the coating bath 10 (GI bath) in each tub according to modification of the embodiment.

As shown in FIG. 11, in the manufacturing method of the galvanized steel sheet according to the modification of the embodiment, the coating bath 10 (GI bath) is circulated by using the circulator in order of the coating tub 1 (for example, bath temperature: 460° C., Al concentration: approximately 0.200 mass %), the separating tub 2 (for example, bath temperature: 440° C., Al concentration: approximately 0.199 mass %), and the adjusting tub 3 (for example, bath temperature: 465° C., Al concentration: approximately 0.205 mass %). In the case, the bath temperature T1, T2, and T3 of the coating tub 1, the separating tub 2, and the adjusting tub 3 respectively satisfies the relation of T3>T1>T2, which is the same as the embodiment of FIG. 10 as explained above. On the other hand, the Al concentration A1, A2, and A3 of the bath in the coating tub 1, the separating tub 2, and the adjusting tub 3 respectively satisfies the relation of A3>A1≥A2, which is different from the embodiment (A2>A3>A1) of FIG. 10 as explained above. The Al concentration A3 of the bath in the adjusting tub 3 is increased by supplying the metal with high Al concentration (first zinc-included-metal) only to the adjusting tub 3 and by not supplying any metal to the separating tub 2. The reason will be described below.

In the embodiment of FIG. 10 as explained above, by supplying the zinc-included-metal with high Al concentration to the separating tub 2, the Al concentration A2 of the separating tub 2 is controlled to be sufficiently higher than the Al concentration A1 of the coating tub 1 (A2>A1). Certainly, in case of manufacturing the GA, it is necessary to control the Al concentration A2 of the separating tub 2 to be higher than the Al concentration A1 of the coating tub 1 (for example, 0.14 mass % or more) in order to precipitate only the top-dross at the separating tub 2. Thereby, since the dross formation range of the coating bath 10B in the separating tub 2 can be transitioned from the bottom-dross and top-dross mixed range to the top-dross formation range, the formation of the bottom-dross can be prevented in the separating tub 2 (refer to FIG. 1).

On the contrary, in case of manufacturing the GI, since the Al concentration A1 of the coating tub 1 is sufficiently high concentration (0.14 mass % or more), it is not necessary to increase the Al concentration A2 of the separating tub 2 such as the GA, and the dross formation range of the GI bath belongs originally to the top-dross formation range (refer to FIG. 1). Thereby, it is possible that all the dross which is precipitated in the separating tub 2 is to be the top-dross only by controlling the bath temperature T2 of the separating tub 2 to be less than the bath temperature T1 of the coating tub 1.

Thus, in the modification as shown in FIG. 11, it is possible to precipitate the top-dross at the separating tub 2 by controlling the bath temperature T2 (440° C.) of the separating tub 2 to be less than the bath temperature T1 (460° C.) and by not supplying any metal to the separating tub 2. In the case, the Al concentration A2 of the separating tub 2 becomes almost the same as the Al concentration A1 of the coating tub 1 (A2=A1), or becomes lower than A1 by the amount of Al which is equivalent to the formation of the top-dross (A2<A1).

After separating by the flotation the top-dross in the separating tub 2, the coating bath 10B in the separating tub 2 is transferred to the adjusting tub 3, and the bath temperature T is increased from T2 (440° C.) to T3 (460° C.). Thereby, since Fe of the coating bath 10C in adjusting tub 3 becomes the unsaturated state, the dross with small size which is contained in the coating bath 10B transferred from the separating tub 2 is dissolved in the coating bath 10C of the adjusting tub 3 and disappears.

Moreover, the first zinc-included-metal is supplied to the adjusting tub 3 in order to supply the molten metal which is consumed at the coating tub 1. The first zinc-included-metal is the zinc-included-metal which includes Al with the concentration higher than the Al concentration A1 in the coating tub 1 (for example, 10 mass % Al-90 mass % Zn). Here, the amount of Al which is included in the zinc-included-metal supplied to the adjusting tub 3 is equivalent to the total of the amount of Al consumed as the top-dross at the separating tub 2 and the amount of Al consumed as the coating layer of the GI at the coating tub 1.

By supplying the zinc-included-metal with high Al concentration to the adjusting tub 3, the Al concentration A3 of the bath in the adjusting tub 3 becomes higher than the Al concentration A1 in the coating tub 1 and the Al concentration A3 of the separating tub 2 (A3≥A1≥A2). Thereby, Zn and Al which are consumed for the coating process at the coating tub 1 are supplied in the adjusting tub 3. Moreover, by controlling the Al concentration A3 of the coating bath 10C in the adjusting tub 3 to approximately the Al concentration (for example, 0.205 mass %) which is intermediate value of the Al concentration A2 of the separating tub 2 and the Al concentration A1 of the coating tub 1 and by transferring the coating bath 10C to the coating tub 1, the Al concentration A1 of the bath in the coating tub 1 can be controlled to the proper concentration (for example, 0.200 mass %) which is suitable for manufacturing the GI.

As described above, in the modification of the embodiment, by supplying the metal only to the adjusting tub 3, the supply for the bath element and the adjustment of the Al concentration are conducted. Therefore, it is not necessary to supply the metal directly to the coating tub 1, so that it is possible to prevent the dross from forming by the change of the bath temperature around the metal. Moreover, since it is not necessary to supply the metal to the separating tub 2, it is possible to simplify the equipment configuration. When the metal is supplied to the adjusting tub 3, the metal may be preliminarily melted by using the premelting tub 4 and the molten metal may be supplied to the adjusting tub 3. Thereby, it is possible to prevent the dross from forming by the change of the bath temperature around the metal in the adjusting tub 3.

In the above, the manufacturing equipment and the manufacturing method of the galvanized steel sheet according to the embodiment were described in detail. According to the embodiment, it is possible that the dross which forms inevitably during manufacturing the hot dip zinc-aluminum coated steel sheets is removed efficiently and effectively at the separating tub 2 and the adjusting tub 3 and is almost-completely rendered harmless. Thereby, the present situation such that the sheet threading speed (coating rate) of the steel sheet 11 is suppressed and the productivity has to be sacrificed in order to prevent the dross from rising in the coating bath 10 is improved, so that the coating rate can be increased and the productivity of the galvanized steel sheets is improved.

EXAMPLE

4. Example

Hereinafter, the examples of the present invention will be described. The following examples only show the test result concretely for the verification of the effect of the present invention, so that the present invention is not limited to the examples.

[4.1. Test 1: Coating Test of the Galvanized Steel Sheet (GI)]

The circulation-type hot-dip-coating equipment (correspond to the hot-dip-coating equipment according to the above described embodiment) was installed in the pilot line, the continuous coating tests which manufactures the galvanized steel sheet (GI) were conducted. The test conditions of the continuous coating test are shown in Table 2. In addition, as comparative examples, the similar tests were conducted by using the conventional hot-dip-coating equipment which had only the coating tub. Here, $\Delta T_{1\text{-}2}$ in Table 2 is the bath temperature difference between the bath temperature T1 of the coating tub 1 and the bath temperature T2 of the separating tub 2 (=T1−T2).

(1) Conventional hot-dip-coating equipment
Capacity Q1 of coating tub: 60 ton
(2) Circulation-type hot-dip-coating equipment
Capacity Q1 of coating tub: 10 ton
Capacity Q2 of separating tub: 40 ton and 12 ton
Capacity Q3 of adjusting tub: 20 ton
Circulating volume q of bath: 10 ton/hour and 6 ton/hour By using the hot-dip-coating equipment, the continuous coating was conducted for 12 hours under the condition where the intended coating weight was 100 g/m$^2$ (both sides) and the coating rate was 100 m/min by using the coil with 0.6 mm in sheet thickness and 1000 mm in sheet width. And the difference of the bath temperature decrease $\Delta T_{fall}$ at transferring the bath from the adjusting tub 3 to the coating tub 1 was 2 to 3° C.

The samples were taken by rapid-cooling the bath of each tub at beginning and ending of the coating. The dross type which was contained in the bath and the dross size and the number per unit observed area were investigated. The dross weight per unit cubic volume (dross density) was obtained. After finishing the test, the bath of the coating tub 1 was drained, and the existence of the sedimented dross was observed at the bottom of the tub.

Moreover, the Al concentration and Fe concentration of each tub were measured every 4 hours.

At the beginning of the coating, since Fe was the unsaturated state in each tub, the dross hardly existed.

All tubs were the ceramic pot, and the induction heating was utilized as the heating apparatus of the temperature controller of each tub. The control accuracy of the bath temperature by the temperature controller of each tub was less than ±3° C. In addition, the circulator of the circulation-type hot-dip-coating equipment was configured by the metal pump for transferring the coating bath from the adjusting tub 3 to the coating tub 1, by the overflow for transferring the coating bath from the coating tub 1 to the separating tub 2, and by the communicating vessel 7 for transferring the coating bath from the separating tub 2 to the adjusting tub 3.

In order to control the Al concentration of the bath in the separating tub 2 and the adjusting tub 3, the metal of 0.38 mass % Al—Zn was supplied to the separating tub 2 as necessary so as to make the bath surface level approximately constant with visual observation. On the other hand, for the conventional hot-dip-coating equipment, the alloyed metal was directly supplied to the coating tub.

The test results are shown in Table 3 and Table 4. Table 3 shows the Al concentration and the Fe concentration of the coating tub, the separating tub, and the adjusting tub as of the lapse of 12 hours, and Table 4 shows the density of the flowed dross in the coating tub and the visual observed amount of the sedimented dross at the bottom of the coating tub as of the lapse of 12 hours.

In addition, the targeted values of the dross density were quantitatively verified by analyzing the coating bath which was sampled under the operational conditions where the dross hardly became the problem because the sheet threading speed of the steel sheet 11 was relative low among the present operational conditions for the GI. Thereby, "0.07 mg/cm$^3$ or less" as the targeted value of the density of the top-dross was obtained.

TABLE 2

| EXAMPLE | CAPACITY OF EACH TUB: COATING TUB Q 1 [t] | SEPARATING TUB Q 2 [t] | ADJUSTING TUB Q 3 [t] | BATH TEMPERATURE OF EACH TUB: COATING TUB T 1[° C.] | SEPARATING TUB T 2[° C.] | ADJUSTING TUB T 3[° C.] | CIRCULATING VOLUME OF BATH q [t/h] | Q 1/q | Q 2/q | $\Delta T_{1-2}$ [° C.] |
|---|---|---|---|---|---|---|---|---|---|---|
| EXAMPLE 1 | 10 | 40 | 20 | 460 | 450 | 465 | 10 | 1.0 | 4.0 | 10 |
| EXAMPLE 2 | 10 | 12 | 20 | 460 | 440 | 465 | 6 | 1.7 | 2.0 | 20 |
| EXAMPLE 3 | 10 | 40 | 20 | 460 | 454 | 465 | 10 | 1.0 | 4.0 | 6 |
| EXAMPLE 4 | 10 | 40 | 20 | 460 | 455 | 465 | 10 | 1.0 | 4.0 | 5 |
| EXAMPLE 5 | 10 | 40 | 20 | 460 | 456 | 465 | 10 | 1.0 | 4.0 | 4 |
| COMPARATIVE EXAMPLE 1 | 10 | 40 | 20 | 460 | 460 | 465 | 10 | 1.0 | 4.0 | 0 |
| COMPARATIVE EXAMPLE 2 | 60 | — | — | 460 | — | — | — | — | — | — |

TABLE 3

| EXAMPLE | COATING TUB: Al CONCENTRATION [mass %] | Fe CONCENTRATION [mass %] | SEPARATING TUB: Al CONCENTRATION [mass %] | Fe CONCENTRATION [mass %] | ADJUSTING TUB: Al CONCENTRATION [mass %] | Fe CONCENTRATION [mass %] |
|---|---|---|---|---|---|---|
| EXAMPLE 1 | 0.201 | 0.011 | 0.196 | 0.007 | 0.207 | 0.007 |
| EXAMPLE 2 | 0.202 | 0.011 | 0.198 | 0.009 | 0.208 | 0.008 |
| EXAMPLE 3 | 0.202 | 0.011 | 0.196 | 0.008 | 0.203 | 0.008 |
| EXAMPLE 4 | 0.202 | 0.011 | 0.193 | 0.009 | 0.209 | 0.008 |
| EXAMPLE 5 | 0.203 | 0.012 | 0.201 | 0.011 | 0.211 | 0.011 |
| COMPARATIVE EXAMPLE 1 | 0.206 | 0.012 | 0.202 | 0.012 | 0.212 | 0.011 |
| COMPARATIVE EXAMPLE 2 | 0.204 | 0.013 | — | — | — | — |

TABLE 4

| EXAMPLE | DENSITY OF FLOWED DROSS: TOP-DROSS [mg/cm$^3$] | BOTTOM-DROSS [mg/cm$^3$] | SEDIMENTED DROSS: BOTTOM-DROSS (VISUAL OBSERVATION) |
|---|---|---|---|
| EXAMPLE 1 | 0.025 | NONE | NONE |
| EXAMPLE 2 | 0.059 | NONE | NONE |
| EXAMPLE 3 | 0.047 | NONE | NONE |
| EXAMPLE 4 | 0.051 | NONE | NONE |
| EXAMPLE 5 | 0.069 | NONE | NONE |
| COMPARATIVE EXAMPLE 1 | 0.171 | NONE | NONE |
| COMPARATIVE EXAMPLE 2 | 0.242 | NONE | NONE |

From the test results as shown in Table 3 and Table 4, in examples 1 to 5, the density of the top-dross was the targeted value "0.07 mg/cm$^3$" or less, so that the effect of the dross removal was confirmed. Especially, in example 1, most of the dross was removed, so that the dross-free was almost-completely achieved. In example 1, the capacity Q2 of the separating tub 2 was 4.0 times (=40/10) of the circulating volume q of the bath per one hour, which was sufficiently higher than 2 times of the criteria. Thus, in example 1, since the time for the flotation separation of the top-dross was sufficiently obtained at the separating tub 2, the density of the top-dross in the coating tub 1 was sufficiently low. Contrary, in example 2, the capacity Q2 of the separating tub 2 was 2.0 times (=12/6) of the circulating volume q of the bath per one hour, which was equal to 2 times of the criteria. Thus, in example 2, since the time for the flotation separation of the top-dross at the separating tub 2 was shortened as compared with that of example 1, the dross separation effect decreased. As the result, in example 2, since the small amount of the top-dross which was formed in the separating tub 2 was flowed back to the coating tub 1, the density of the top-dross in the coating tub 1 was higher than that of example 1.

On the other hand, in comparative example 1, the large amount of the top-dross existed. The reason seems that, since the bath temperature T2 of the separating tub 2 equalized with the bath temperature T1 of the coating tub 1, the dross removal effect decreased in the separating tub 2. In addition, in comparative example 2 of the conventional coating tub, the density of the top-dross was excessively larger than the targeted value "0.07 mg/cm$^3$". The reason seems that the coating test was conducted by using only the coating tub without installing the separating tub and the adjusting tub and that the metal was melted in the coating tub.

As shown in Table 2, the bath temperature T2 of the separating tub 2 was 454° C. in example 3, 455° C. in example 4, and 456° C. in example 5, and thereby the bath temperature difference $\Delta T_{1-2}$ (=T1−T2) between the bath temperature T1 (460° C.) of the coating tub 1 and the bath temperature T2 of the separating tub 2 was controlled to 6° C. in example 3, 5° C. in example 4, and 4° C. in example 5. From examples 3 to 5, the influence of the bath temperature difference $\Delta T_{1-2}$ on the dross formation was verified. As the results, as shown in Table 4, in examples 1 to 4, since the bath temperature difference $\Delta T_{1-2}$ between the bath temperature T1 of the coating tub 1 and the bath temperature T2 of the separating tub 2 was 5° C. or more (T1−T2≥5° C.), the density of the flowed dross was notably low and the effect of the present invention was sufficiently obtained. On the other hand, in example 5, since the bath temperature difference $\Delta T_{1-2}$ was less than 5° C. (T1−T2<5° C.) (for example, 4° C.), the density of the flowed dross was close to the upper limit (0.07 mg/cm$^3$) which was the target, and the small amount of sedimented dross was also formed. In other words, it was confirmed that, although the effect of the present invention was obtained, the effect decreased in example 7. Therefore, it is preferable that the bath temperature difference $\Delta T_{1-2}$ between the bath temperature T1 of the coating tub 1 and the bath temperature T2 of the separating tub 2 is 5° C. or more.

[4.2. Test 2: Verification Test of Separation Efficiency of Bottom-Dross and Top-Dross]

Next, the results of the test to verify the separation efficiency of the bottom-dross and the top-dross by using the separation by the difference in specific gravity will be described.

The specific gravity of the top-dross is 3900 to 4200 kg/m$^3$, and the specific gravity of the bottom-dross is 7000 to 7200 kg/m$^3$.

By analyzing the results of the flow simulation which simulated the dross separation by the flotation (sedimentation) under the condition where the separating tub 2 was 2.8 m in width×3.5 m in length×1.8 m in height (capacity 120 ton) and the circulating volume of bath was 40 ton/hour, the results as shown in Table 5 were obtained. Table 5 shows the efficiency of the separation by the difference in specific gravity of the top-dross and the bottom-dross.

TABLE 5

| TOP-DROSS | | BOTTOM-DROSS | |
|---|---|---|---|
| SIZE | EFFICIENCY OF FLOTATION SEPARATION | SIZE | EFFICIENCY OF SEDIMENTATION SEPARATION |
| 50 μm | 100% | 50 μm | 53% |
| 30 μm | 98% | 30 μm | 21% |
| 10 μm | 40% | 10 μm | 4% |

From the test results as shown in Table 5, the separation efficiency of the top-dross was higher than that of the bottom-dross in any case that the grain size was 50 μm, 30 μm, and 10 μm. Therefore, it is confirmed that the dross separation by the difference in specific gravity is effective under the condition of the top-dross.

[4.3. Test 3: Verification Test of Capacity of Separating Tub]

Next, the results of the test to investigate, by using the flow analysis, the capacity Q2 of the separating tub 2 which is required to separate effectively and sufficiently the top-dross by the flotation at the separating tub 2 will be described. The prerequisites of the analysis were as follows.

Circulating volume of bath: 40 ton/hour

Capacity of separating tub: 20 to 160 ton

Size of top-dross: 30 μm

Figure 12:
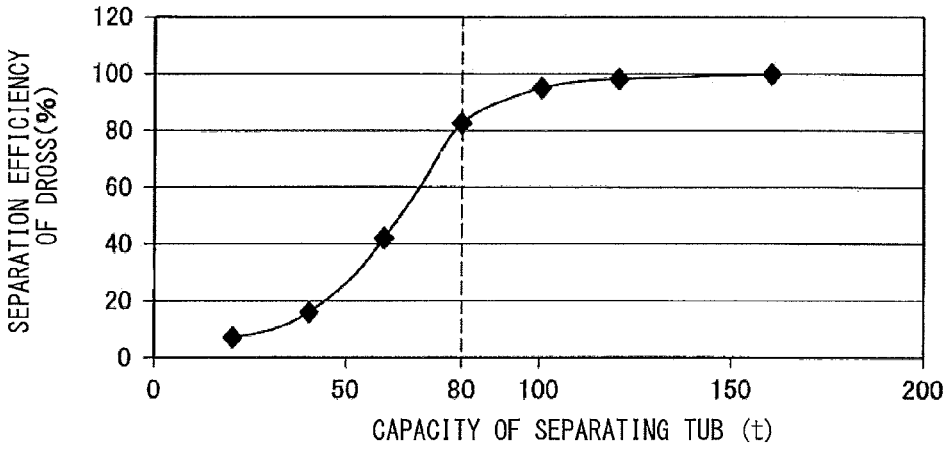
FIG. 12 is a graph which indicates a relationship between capacity of the separating tub and a dross separation ratio according to examples of the present invention.

The result of the analysis test is shown in FIG. 12. As shown in FIG. 12, when the capacity Q2 of the separating tub 2 is 2 times or more of the circulating volume q (40 ton/hour) of the coating bath per one hour, the separation efficiency of the dross becomes 80% or more. When the capacity Q2 of the separating tub 2 is less than 2 times of the circulating volume q of the bath, the separation efficiency of the dross decreases drastically. From the result, it turns out that it is preferable that the capacity Q2 of the separating tub 2 is 2 times or more of the circulating volume q of the bath ((Q2/q)≥2).

[4.4. Test 4: Verification Test of Capacity of Coating Tub]

Next, the results of the bath circulation test to investigate the stagnation time of the coating bath 10A so that the dross which is formed in the coating bath 10A (GI bath) of the coating tub 1 does not grow up to the harmful size by using the pilot line of the galvanizing will be described. The test conditions were as follows.

Criterial bath temperature T1 of the coating tub (intended bath temperature): 460° C.

Al concentration of bath: 0.20 mass %

Fe concentration of bath: Saturation (0.3 mass %)

Steel sheet: 0.6 mm in sheet thickness and 1000 mm in sheet width

Coating rate: 100 m/min

Coating weight: 100 g/m$^2$ (both sides)

Bath temperature fluctuation: ±5° C. (fluctuated intentionally by controlling the heating output)

Capacity Q1 of coating tub: 60 ton

Circulating volume q of bath: 5 to 60 ton/hour

After changing the circulating volume of the bath, the circulating volume q of the bath was kept constant until the coating bath in the coating tub 1 was completely replaced. Specifically, bath circulation was continued until the coating bath of 3 times of the capacity Q1 of the coating tub 1 was circulated and finished.

The samples were taken from the coating bath which was overflowed from the coating tub 1 just before each level of the bath circulation test was finished, and the size of the dross which existed in the bath was measured.

In addition, the bath temperature fluctuation of the coating tub 1 in the actual operation is generally less than the test condition of this time which was ±5° C., and is approximately ±3° C. However, in order to confirm the conditions to make the dross harmless stably, the test was conducted under the condition where the dross tended to form and grow as compared with the general condition.

Figure 13:
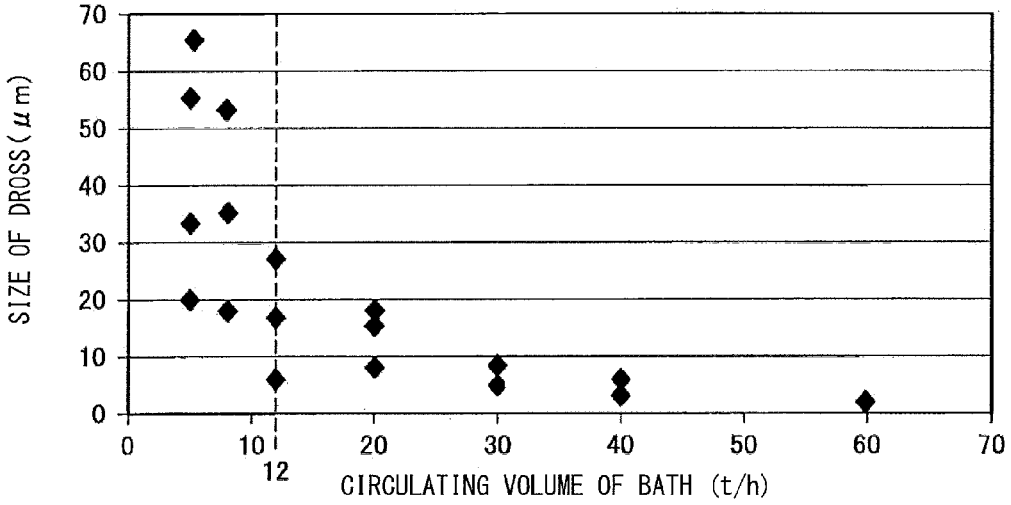
FIG. 13 is a graph which indicates a relationship between circulating volume of bath and dross size according to the examples.

The result of the test is shown in FIG. 13. As shown in FIG. 13, when the circulating volume q of the bath per one hour was less than 12 ton/hour (namely, the capacity Q1 of the coating tub 1 was more than 5 times of the circulating volume q of the bath per one hour (Q1/q)>5), the maximum size of the dross which was actually observed was larger than the harmful size (50 μm). The reason seems that, since the stagnation time of the coating bath in the coating tub 1 was prolonged, the dross notably grew up to the harmful size. Contrary, when the circulating volume q of the bath per one hour was 12 ton/hour or more (namely, the capacity Q1 of the coating tub 1 was 5 times or less of the circulating volume q of the bath per one hour (Q1/q)≤5), the dross with small size (approximately 27 μm or less) which was sufficiently smaller than the harmful size (50 μm) was only observed. The reason seems that, since the stagnation time of the coating bath in the coating tub 1 was short, the dross did not grow up to the harmful size. Therefore, it turns out that it is preferable that the capacity Q1 of the coating tub 1 is 5 times or less of the circulating volume q of the bath per one hour.

[4.5. Test 5: Verification Test of Proper Range of Inflow Bath Temperature of Coating Tub]

Next, the results of the test to verify the proper range of the bath temperature T3 of the coating bath 10C which flows into the coating tub 1 from the adjusting tub 3 will be described. When the bath temperature T3 of the coating bath 10C which flows into the coating tub 1 from the adjusting tub 3 deviates excessively from the bath temperature T1 of the coating tub 1, the bath temperature deviation in the coating tub 1 is promoted. As the result, it seems that the formation and the growth of the dross in the coating tub 1 are accelerated. Thus, the verification test of proper range of the bath temperature T3 of the adjusting tub 3 was conducted by using the pilot line of the galvanizing. The test conditions were as follows.

Criterial bath temperature T1 of the coating tub (intended bath temperature): 460° C.

Al concentration of bath: 0.20 mass %

Fe concentration of bath: Saturation (0.3 mass %)

Steel sheet: 0.6 mm in sheet thickness and 1000 mm in sheet width

Coating rate: 100 m/min

Coating weight: 100 g/m$^2$ (both sides)

Bath temperature fluctuation: ±5° C. (fluctuated intentionally by controlling the heating output)

Capacity Q1 of coating tub: 60 ton

Circulating volume q of bath: 20 ton/hour

Inflow bath temperature ($T3-\Delta T_{fall}$): 445 to 480° C. ($\Delta T_{fall}$ the difference of the bath temperature decrease and the bath temperature which decreases naturally when the coating bath 10C is transferred from the adjusting tub 3 to the coating tub 1)

After changing the inflow bath temperature, the circulating volume q of the bath was kept constant until the coating bath in the coating tub 1 was completely replaced. Specifically, bath circulation was continued until the coating bath of 3 times of the capacity Q1 of the coating tub 1 was circulated and finished.

The samples were taken from the coating bath which was overflowed from the coating tub 1 just before each level of the bath circulation test was finished, and the size of the dross which existed in the bath was measured.

In addition, the bath temperature fluctuation of the coating tub 1 in the actual operation is generally less than the test condition of this time which was ±5° C., and is approximately ±3° C. However, in order to confirm the conditions to make the dross harmless stably, the test was conducted under the condition where the dross tended to form and grow as compared with the general condition.

Figure 14:
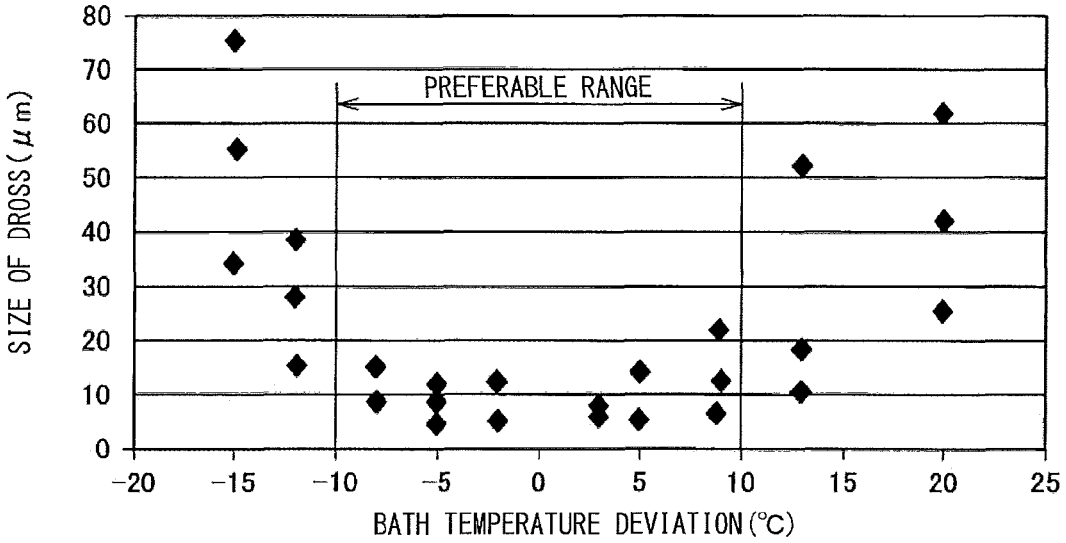
FIG. 14 is a graph which indicates a relationship between a bath temperature deviation of an inflow bath of the coating tub and the dross size according to the examples.

The result of the test is shown in FIG. 14. As shown in FIG. 14, when the bath temperature deviation ($T3-\Delta T_{fall}-T1$: hereinafter, referred to as inflow bath temperature deviation) between the inflow bath temperature ($T3-\Delta T_{fall}$) of the coating bath which flows into the coating tub 1 from the adjusting tub 3 and the bath h temperature T1 of the coating tub 1 is not within 10° C. ($T3-\Delta T_{fall}-T1>10°$ C. or $T3-\Delta T_{fall}-T1<10°$ C.), it turns out that the size of the dross which forms in the coating tub 1 may be larger than the harmful size (for example, 50 μm). Contrary, when the inflow bath temperature deviation is −10° C. or more and 10° C. or less ($-10° C.\leq T3-\Delta T_{fall}-T1\leq 10°$ C.), only the dross (for example, approximately 22 μm or less) which is sufficiently smaller than the harmful size forms. Thus, in order to suppress the formation of the dross with the harmful size in the coating tub 1, it is preferable that the inflow bath temperature deviation is −10° C. or more and 10° C. or less. In other words, it is preferable that the bath temperature T3 of the adjusting tub 3 is within the range of ±10° C. ($T1+\Delta T_{fall}-10\leq T3\leq T1+\Delta T_{fall}+10$) on the basis of the temperature ($\Delta T_{fall}+T1$) in which the difference of the bath temperature decrease $\Delta T_{fall}$ at transferring the bath from the adjusting tub 3 to the coating tub 1 is added to the bath temperature T1 of the coating tub 1. Conventionally, when the bath temperature deviation of the coating bath increases, it has been expected that the formation and the growth of the dross are accelerated. However, the specific range of the bath temperature deviation which promotes the formation of the dross with the harmful size has not known. From the test results, in order to suppress the formation of the dross with the harmful size in the coating tub 1, it turns out that the bath temperature T3 of the adjusting tub 3 may be within the range of ±10° C. on the basis of the temperature in which the difference of the bath temperature decrease $\Delta T_{fall}$ is added to the bath temperature T1 of the coating tub 1.

As described above, although the preferable embodiment of the present invention was described in detail with reference to the drawings, the present invention is not limited to the embodiment. It is obvious that a person ordinarily skilled in the art of the invention can conceive the alterations and the modifications within the technical ideas used in the scope of claims, so that it is obviously understood that these belong implicitly to the technical scope of the present invention.

The present invention can be widely applied to the hot dip zinc-aluminum coated steel sheets which are manufactured by using the coating bath 10 whose specific gravity is higher than the specific gravity of the top-dross ($Fe_2Al_5$), such as the galvannealed steel sheets (GA) for which both of the bottom-dross and the top-dross can form, the zinc-aluminum alloy coated steel sheets, and the like in addition to the galvanized steel sheets (GI). When the amount of the aluminum increases and the specific gravity of the coating bath 10 is less than the specific gravity of the top-dross, the dross cannot separated by the flotation, which is a requirement for the present invention. Therefore, the applicable scope of the present invention is the hot dip zinc-aluminum coated steel sheets in which the aluminum content is less than 50 mass %.

In addition, in the coated steel sheets which are manufactured by the coating bath with high aluminum content other than the galvannealed steel sheets, it is not necessary that the bath composition of the separating tub 2 and the adjusting tub 3 is intentionally changed like the above mentioned embodiment, and it is possible that the coating bath 10 in which the top-dross is almost not contained by controlling only the bath temperature T. Thereby, the problems such as the appearance deterioration of the surface of the steel sheet caused by the dross adhesion, surface defects caused by the dross, the roll-slipping caused by the dross precipitation on the surface of the roll in the coating bath, and the like can be solved.

INDUSTRIAL APPLICABILITY

According to the present invention, it is possible that the dross which forms inevitably in the coating bath during the manufacture of the galvanized steel sheet can be removed efficiently and effectively and can be almost-completely rendered harmless. Accordingly, the present invention has significant industrial applicability.

REFERENCE SIGNS LIST

1 COATING TUB
2 SEPARATING TUB
3 ADJUSTING TUB
4 PREMELTING TUB
5 MOLTEN METAL TRANSFER APPARATUS
6, 7 COMMUNICATING VESSEL
8 TRANSFERRING VESSEL
9 OVERFLOWING VESSEL
10, 10A, 10B, 10C COATING BATH
11 STEEL SHEET
12 SINK ROLL
13 GAS WIPING NOZZLE

The invention claimed is:

1. A manufacturing method of a galvanized steel sheet, the manufacturing method comprising:

circulating a coating bath which is a molten metal including a molten zinc and a molten aluminum in order of a coating tub, a separating tub, and an adjusting tub;

coating a steel sheet which is dipped in the coating bath at the coating tub in which the coating bath transferred from the adjusting tub is stored at a predetermined bath temperature T1;

separating by a flotation a top-dross which is precipitated at the separating tub in which the coating bath transferred from the coating tub to the separating tub is stored at a bath temperature T2 which is lower than the bath temperature T1 of the coating tub;

dissolving a residual dross at the adjusting tub in which the coating bath transferred from a lower part of the separating tub is stored at a bath temperature T3 which is higher than the bath temperature T2 of the separating tub; and decreasing a temperature of the coating bath of the separating tub to a temperature lower than a temperature of the coating bath of the coating tub, thereby preventing a formation of bottom-dross, and removing top-dross separated by the flotation, wherein an aluminum concentration in the coating bath of the separating tub is more than 0.14% by mass, wherein an aluminum concentration in the coating bath of the coating tub is 0.15% to 0.25% by mass, and wherein a first zinc-included-metal which includes an aluminum with a concentration higher than the aluminum concentration of the coating bath in the coating tub is supplied to the adjusting tub and is not supplied to the separating tub.

2. The manufacturing method for the galvanized steel sheet according to claim 1, wherein the bath temperature T2 of the separating tub is at least 5° C. lower than the bath temperature T1 of the coating tub and is higher than a melting point of the molten metal.

3. The manufacturing method for the galvanized steel sheet according to claim 1, wherein the bath temperature T1, the bath temperature T2, and the bath temperature T3 satisfy a following formula (1) and a following formula (2) in degrees celsius, when a difference of a bath temperature decrease of the coating bath when transferred from the adjusting tub to the coating tub is $\Delta T_{fall}$ in degrees celsius $$T1+\Delta T_{fall}-10 \leq T3 \leq T1+\Delta T_{fall}\pm 10 \quad (1)$$

$$T2+5 \leq T3 \quad (2).$$

4. The manufacturing method for the galvanized steel sheet according to claim 1, wherein at least two of the coating tub, the separating tub, or the adjusting tub are made by dividing one tub with a weir, and a bath temperature of each tub which is divided by the weir is controlled independently.

5. The manufacturing method for the galvanized steel sheet according to claim 1, wherein a storage of the coating bath in the coating tub is five times or less of a circulating volume of the coating bath per one hour.

6. The manufacturing method for the galvanized steel sheet according to claim 1, wherein a storage of the coating bath in the separating tub is two times or more of a circulating volume of the coating bath per one hour.

* * * * *